US009927755B2

(12) United States Patent
Okada

(10) Patent No.: US 9,927,755 B2
(45) Date of Patent: Mar. 27, 2018

(54) IMAGE FORMING APPARATUS HAVING DEVELOPER SUPPLYING CONTROL

(71) Applicant: CANON KABUSHIKI KAISHA, Tokyo (JP)

(72) Inventor: Noriyuki Okada, Matsudo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/056,041

(22) Filed: Feb. 29, 2016

(65) Prior Publication Data

US 2016/0179048 A1 Jun. 23, 2016

Related U.S. Application Data

(63) Continuation of application No. PCT/JP2014/074151, filed on Sep. 5, 2014.

(30) Foreign Application Priority Data

Sep. 5, 2013 (JP) ..... 2013-183650

(51) Int. Cl.
*G03G 15/08* (2006.01)
*G03G 15/00* (2006.01)
*G03G 15/09* (2006.01)

(52) U.S. Cl.
CPC ..... *G03G 15/556* (2013.01); *G03G 15/0853* (2013.01); *G03G 15/0907* (2013.01)

(58) Field of Classification Search
CPC ..... G03G 15/556
(Continued)

(56) References Cited

U.S. PATENT DOCUMENTS 5,754,916 A * 5/1998 Kitayama ..... G03G 15/0849 222/DIG. 1
6,999,689 B2 2/2006 Kinoshita et al.
(Continued)

FOREIGN PATENT DOCUMENTS

EP 2 549 333 A2 1/2013
JP 10-010929 A 1/1998
(Continued)

OTHER PUBLICATIONS

PCT International Search Report and the Written Opinion dated Nov. 12, 2014, Sep. 6, 2016.
(Continued)

*Primary Examiner* — Quana M Grainger
(74) *Attorney, Agent, or Firm* — Fitzpatrick, Cella, Harper & Scinto

(57) ABSTRACT

An image forming apparatus includes an image bearing member, a developing device configured to develop an electrostatic image formed on the image bearing member into a toner image, and an exchangeable developer container configured to supply the developer into the developing device. A content sensor detects information relating to a toner content in the developing device, and an exchange detecting portion detects an exchanging operation of the developer container. A controller controls a supplying operation for supplying the developer from the developer container to the developing device on the basis of a detection result of the content sensor and executes a developer supplying mode for supplying developer prohibiting an image forming operation. The controller controls the supplying operation so as to permit the image forming operation without executing the developer supplying mode until an amount of formed images reaches a predetermined level.

53 Claims, 12 Drawing Sheets

(58) Field of Classification Search
USPC ..... 399/27
See application file for complete search history.

(56) References Cited

U.S. PATENT DOCUMENTS

| | | | | |
|---|---|---|---|---|
| 7,620,334 | B2 | 11/2009 | Shimizu | |
| 2003/0072580 | A1* | 4/2003 | Itoh | G03G 15/0849 399/62 |
| 2010/0014876 | A1 | 1/2010 | Shimizu | |
| 2010/0166439 | A1 | 7/2010 | Nishimura | |
| 2013/0045017 | A1* | 2/2013 | Hayakawa | G03G 21/1878 399/24 |

FOREIGN PATENT DOCUMENTS

| | | | |
|---|---|---|---|
| JP | 2005-062848 | A | 3/2005 |
| JP | 2005-242039 | A | 9/2005 |
| JP | 2006-171361 | A | 6/2006 |
| JP | 2007-065325 | A | 3/2007 |
| JP | 2008-070794 | A | 3/2008 |
| JP | 2009-282250 | A | 12/2009 |

OTHER PUBLICATIONS

European Search Report dated Mar. 17, 2017, in related European Patent Application No. 14841722.3.

* cited by examiner

IMAGE FORMING APPARATUS HAVING DEVELOPER SUPPLYING CONTROL

The present invention relates to an image forming apparatus for supplying a reservoir developer into a developing device from an exchangeable developer container. More particularly, it relates to a control in which even if the image forming operation is started soon after exchange of the developer container, the decrease of the toner content of the developer after the start can be kept within a tolerable range.

BACKGROUND ART

An image forming apparatus provided with a developing device for developing an electrostatic image formed on an image bearing member, into a toner image, using the developer (two component developer) containing toner and carrier is widely used. An image forming apparatus comprising an exchangeable developer container containing a reservoir developer including toner in which the reservoir developer is exchanged to supply the developer is widely used. Ordinarily, the developing device is provided with a sensor for detecting a toner content (toner weight ratio in the developer), and an amount of the developer response to the sensor output and the toner consumption amount for each image forming operation is supplied into the developing device in accordance with image forming operation.

In the image forming apparatus provided with the exchangeable developer container, it is not the fact that immediately after the start of the supply of the reservoir developer by the developer supply portion after the exchange of the developer container, the supplied developer flows into the developing device. Not less than ten sec is required for the developer supplied from the developer container to reach and to be stirred and mixed and to recover the toner content.

For this reason, with the image forming apparatus provided with the exchangeable developer container, it is ordinary that when the developer container is exchanged, the image forming operation is temporarily interrupted, and the developer supply portion is operated for not less than ten sec, and then the image forming operation is permitted (Japanese Laid-open Patent Application 2005-62848).

However, in the case that the developer supply portion is automatically operated after the exchange of the developer container, the image forming operation is not possible for that time period, with the result of down time of the image forming apparatus. Particularly in the case of a full-color image forming apparatus comprising a plurality of developing containers, the frequency of the occurrences of such down time is multiplied by the number of the developer containers.

In view of this, Japanese Laid-open Patent Application 2007-65325 discloses an image forming apparatus of one component developing type (magnetic toner type), in which the image forming operation is enabled to start immediately after the exchange of the developer container. The developer supply portion is provided with a multi-level toner level sensor, and the image forming operation is stopped only when the toner level becomes lower than the lowest toner level, and the toner supply from the developer supply portion is continued.

In the two component developing type developing device, the developer amount in the developing device hardly changes whatever amount of the toner is consumed, and therefore, the method using the toner level sensor disclosed in Japanese Laid-open Patent Application 2007-65325 cannot be employed. Then, it has been proposed that the image forming operation is permitted immediately after the exchange of the developer container, and thereafter, when the toner content in the developing device becomes lower than a first reference value which is set to be lower than the normal level, the image forming operation is prevented, and the toner supply from the developer supply portion is continued.

However, the output of the toner density sensor significantly changes depending on the temperature and humidity, the toner charge amount and the fluidity state of the developer, and therefore, the discrimination based on the output of the toner density sensor may lead to failure of the necessary prevention of the image forming operation. If the first reference value is raised in a attempt to assure the prevention of the image forming operation in order to avoid excessive decrease of the toner content, the frequency of unnecessary preventions of the image forming operation increases, with the result of increase of the down time of the image forming apparatus.

SUMMARY OF THE INVENTION

Problem to be Solved

It is an object of the present invention to avoid unnecessary prevention of the image forming operation while assuring necessary prevention of the image forming operation, so that the decrease of the toner content in the developing device beyond the tolerable range is avoided, and the down time of the image forming apparatus is reduced.

Means for Solving the Problem

According to an aspect of the present invention, there is provided an image forming apparatus comprising an image bearing member capable of carrying an electrostatic image; a developing device configured to develop an electrostatic image formed on said image bearing member into a toner image, using a developer including toner and carrier; an exchangeable supply container configured to supply the developer into said developing device; a content sensor capable of detecting information relating to a toner content in said developing device; an exchange detecting portion configured to detect information for discriminating an event of exchanging operation of said supply container; and a controller configured to control a supplying operation from said supply container, on the basis of a detection result of said content sensor, wherein said controller is capable of prohibiting an image forming operation on the basis of the detection result of said content sensor and is capable of releasing the prohibition of the image forming operation on the basis of the detection result of said exchange sensor, and wherein after releasing the prohibition of the image forming operation on the basis of the detection result of said exchange sensor, said controller continues permission of the image forming operation irrespective of the detection result of said content sensor when the information relating to a toner consumption amount cumulated every image formations indicates an amount less than a predetermined amount, and when the toner consumption amount after the release of the prohibition of the image forming operation reaches the predetermined amount, said controller determines whether to prohibit the image forming operation on the basis of the detection result of said content sensor after the toner consumption amount reaches the predetermined amount.

Advantageous Effect of the Invention

According to the present invention, there is provided a image forming apparatus in which unnecessary prevention of the image forming operation is avoided, while assuring necessary prevention of the image forming operation, so that the decrease of the toner content in the developing device beyond the tolerable range is avoided, and the down time of the image forming apparatus is reduced.

DESCRIPTION OF THE EMBODIMENTS

The embodiments of the present invention will be described in detail in conjunction with the accompanying drawings.

Embodiment 1

Figure 2:
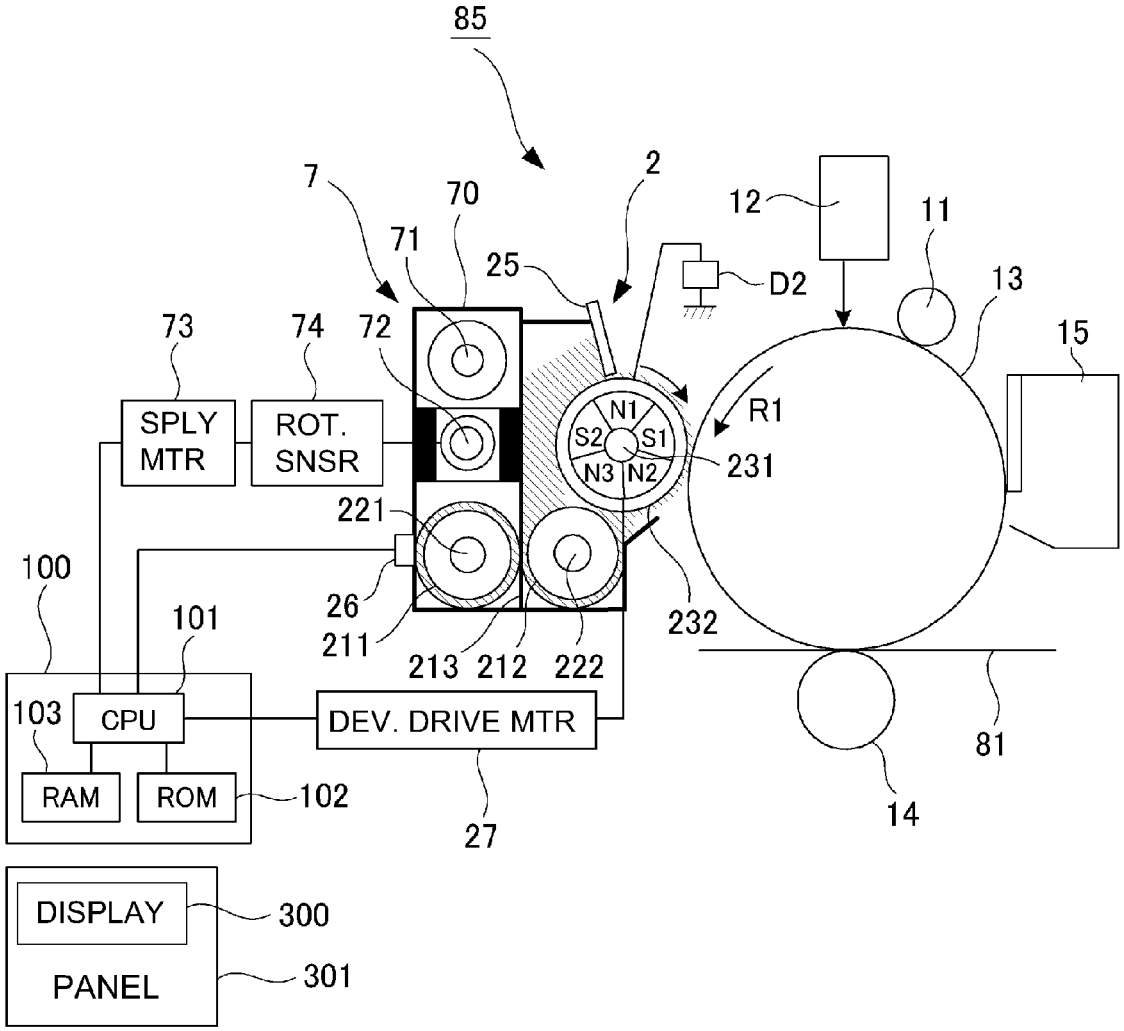
FIG. 2 is an illustration of a structure of an image forming station.

As shown in FIG. 2, a photosensitive drum 13 which is an example of an image bearing member is capable of carrying an electrostatic image. A developing device 2 which is an example of a developing device develops an electrostatic image on the photosensitive drum 13 into a toner image, using a developer including toner and carrier. A developer supply portion 7 which is an example of a supplying portion supplies the reservoir developer into the developing device 2 from a toner bottle 70 which is an example of the developer container exchangeably provided.

An inductor sensor 26 which is an example of detecting means is capable of detecting the toner content in the developing device. A toner bottle sensor 76 which is an example of exchange detecting means detects the information for discriminating whether or not the exchanging operation of the toner bottle 70 is carried out.

A controller 100 which is an example of the controller controls the supplying operation of the developer supply portion 7 on the basis of the detection result of the inductor sensor 26. The controller 100 supplies the reservoir developer in accordance with the image forming operation on the basis of the toner consumption amount for each image formation based on input image information and the detection result of the toner content in the developing device, so that the toner content of the developer is maintained at a predetermined reference value.

(Image Forming Apparatus)

Figure 1:
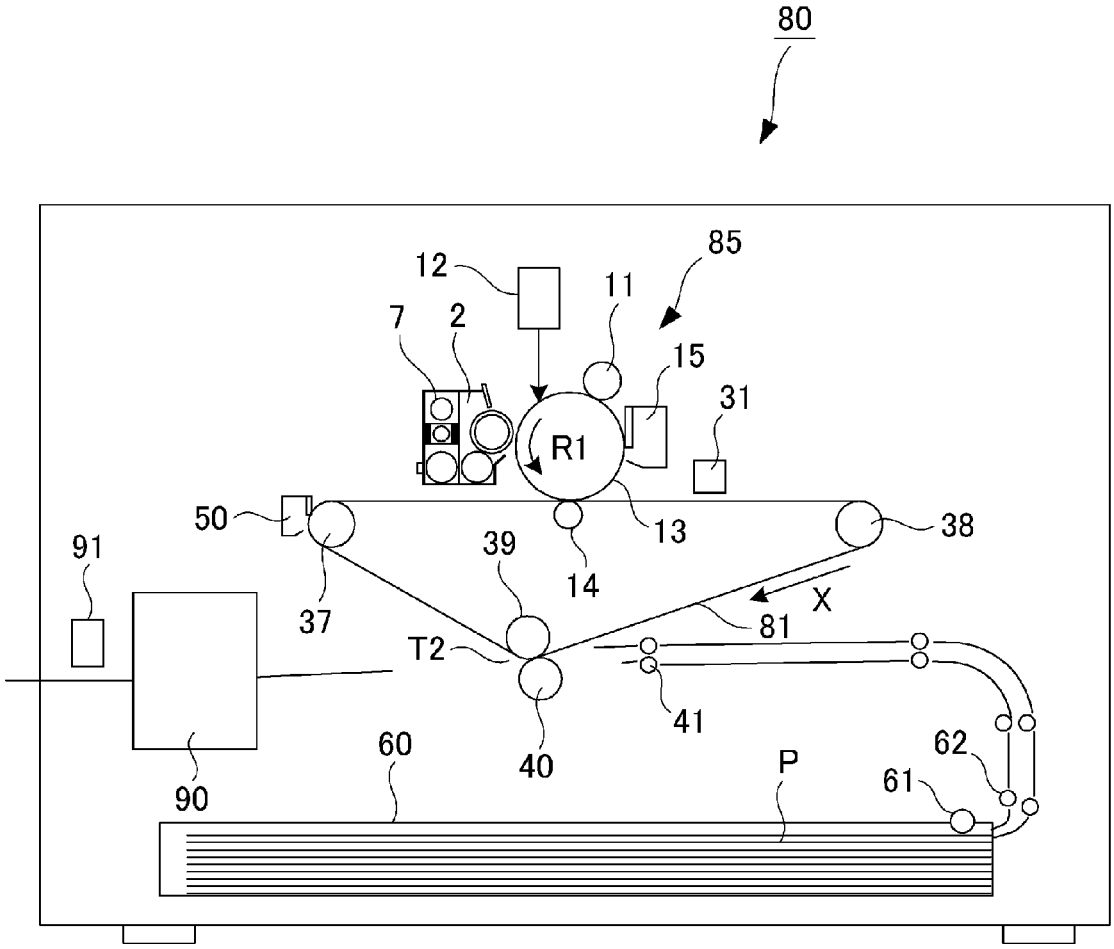
FIG. 1 is an illustration of a structure of an image forming apparatus.

FIG. 1 is an illustration of the structure of the image forming apparatus. As shown in FIG. 1, the image forming apparatus 80 is a monochromatic printer of an intermediary transfer type, which comprises an image forming station 85 disposed above an upper surface of an intermediary transfer belt 81.

In the image forming station 85, the toner image is formed on the photosensitive drum 13 and is transferred onto the intermediary transfer belt 81.

The toner image transferred onto the intermediary transfer belt 81 is conveyed to a secondary transfer portion T2, where it is secondary-transferred onto a recording material P. A separation roller 62 singles the recording material P out of a recording material cassette 60 and feeds the recording material P to registration rollers 41. The registration rollers 41 feeds the recording material P to the secondary transfer portion T2 in timed relationship with the toner image on the intermediary transfer belt 81. The recording material P now carrying the secondary-transferred toner image is subjected to heat and pressure in a fixing device 90 so that the image is fixed on the surface of the recording material P.

The intermediary transfer belt 81 is extended around and is supported by a tension roller 37, an opposing roller 39 and a driving roller 38, and is driven by the driving roller 38 to rotate in the direction indicated by an arrow X. The secondary transfer roller 40 contacts with the intermediary transfer belt 81 supported by the opposing roller 39 to form the secondary transfer portion T2. The secondary transfer roller 40 is supplied with a DC voltage of the positive, so that the toner image is transferred from the intermediary transfer belt 81 onto the recording material P. The belt cleaning device 50 includes a cleaning blade rubbing the intermediary transfer belt 81 to collect untransferred toner deposited on the surface of the intermediary transfer belt 81.

(Image Forming Station)

FIG. 2 is an illustration of a structure of the image forming station. As shown in FIG. 2, the image forming station 85 comprises a charging device 11, an exposure device 12, a developing device 2, a transfer roller 14 and a drum cleaning device 15 which are disposed around the photosensitive drum 13. The photosensitive drum 13 includes an aluminum cylinder and a photosensitive layer on the outer peripheral surface thereof and is rotated in a direction indicated by an arrow R1 at a predetermined process speed.

The charging device 11 applies to the charging roller an oscillating voltage comprising a negative DC voltage VD and an AC voltage, so as to electrically charge the photosensitive drum 13 uniformly to a negative potential VD. In this embodiment, the DC voltage VD=−600V, and the AC voltage Vac=1.5 kVpp.

The exposure device 12 scans the surface of the photosensitive drum 13 with a laser beam deflected by a rotational mirror, the laser beam being ON-OFF modulated in accordance with scanning line image signal provided by expanding the image information, by which an electrostatic image is formed. The charge of the dark portion potential VD=−600V on the surface of the photosensitive drum 13 is attenuated by the exposure, so that the electrostatic image having the light portion potential VL=100V is formed. The strength of the laser beam produced by the exposure device 12 can be changed in the range of 0-255, and by changing the light intensity of the laser, the potential of the electrostatic image can be changed. The potential on the photosensitive drum 13 when the laser beam strength is changed in the range of 0-255 is V (L).

The developing device 2 develops the electrostatic image into the toner image on the photosensitive drum 13. The transfer roller 14 urges the intermediary transfer belt 81 to form a transfer portion between the photosensitive drum 13 and the intermediary transfer belt 81. By the application of the positive DC voltage to the transfer roller 14, the toner image of the negative polarity carried on the photosensitive drum 13 is transferred onto the intermediary transfer belt 81. The drum cleaning device 15 includes a cleaning blade rubbing the photosensitive drum 13 to remove the untransferred toner from the surface of the photosensitive drum 13.

(Developing Device)

The developing device 2 uses a two component developer comprising the toner (non-magnetic) having the negative charge polarity and carrier (magnetic) having the positive charge polarity. The inside of the developing device 2 is positioned by a partition 213 into a developing chamber 212 and a stirring chamber 211. Front side and rear side end portions of the partition 213 are provided with respect to openings for fluid communication between the developing chamber 212 and the stirring chamber 211.

The developing chamber 212 is provided with a first feeding screw 222. The first feeding screw 222 functions to supply the developer onto the developing sleeve 232 while feeding and stirring the developer. The toner of the developer carried on the developing sleeve 232 is consumed in the portion where it is opposed to the photosensitive drum 13, and the developer having a reduced toner content is returned into the developing chamber 212. The developer having the reduced toner content is fed into the stirring chamber 211 through the downstream opening of the developing chamber 212.

The stirring chamber 211 is provided with a second feeding screw 221. The second feeding screw 221 mixes the unused toner supplied from the developer supply portion 7 and the developer already in the stirring chamber 211 with each other while feeding the developer, thus uniformizing the toner content of the developer. The developer now supplied with the toner to a proper toner content is supplied into the developing chamber 212 through the downstream opening of the stirring chamber 211. The developing sleeve 232, the first feeding screw 222 and the second feeding screw 221 are driven by a common development driving motor 27.

The developing chamber 212 is provided with a rotatable developing sleeve 232. In the developing sleeve 232, a magnet 231 having magnetic poles at the peripheral surface thereof is non-rotatably provided. The number of the magnetic poles of the magnet 231 is preferably not less than three, and is five in this embodiment. The developer stirred by the first feeding screw 222 in the developing chamber 212 is confined on the surface of the developing sleeve 232 by the magnetic force provided by a scooping pole N3 of the magnet 231 and is carried with the rotation of the developing sleeve 232. The developer is formed into magnetic chains by the cutting pole S2 of the magnet 231, the magnetic chains being erected from the surface of the developing sleeve 232. The erected magnetic chains are cut by a regulating blade 25 into a predetermined height, so that a developer layer having a uniform layer thickness is formed on the developing sleeve 232. The thus regulated developer is carried into a developing zone where it is opposed to the photosensitive drum 13, by the rotation of the developing sleeve 232, and is erected from the surface of the developing sleeve 232 by the magnetic force provided by a developing pole N1 to form a magnetic brush of the developer.

In the state that the magnetic brush of the developer is rubbing the surface of the photosensitive drum 13, the voltage source D2 applies to the developing sleeve 232 the oscillating voltage comprising the DC voltage and the AC voltage. In this embodiment, the DC voltage Vdc=−500V biased with the AC voltage Vac=1.3 kVpp is used. By this, only the toner that is charged to the negative polarity is transferred from the magnetic brush onto the electrostatic image of the photosensitive drum 13. On the surface of the photosensitive drum 13, the toner image having the toner amount corresponding to a development contrast Vcont=−100V−(−500V) which is a difference potential between the light portion potential DL and the DC voltage Vdc is formed by the development.

(Developer Supply Portion)

Figure 3:
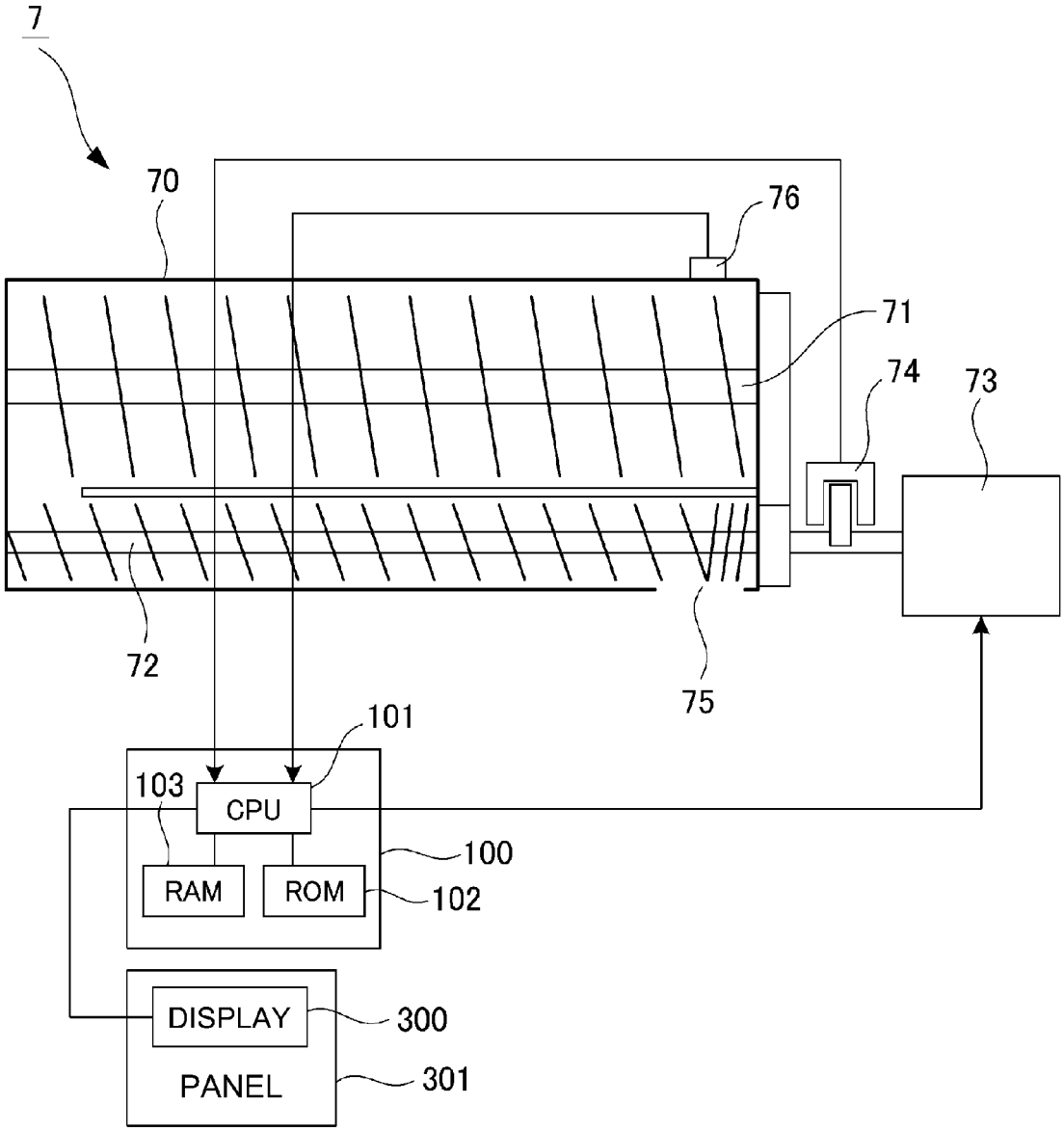
FIG. 3 is an illustration of a structure of a developer supply portion.

FIG. 3 is an illustration of a structure of the developer supply portion. As shown in FIG. 2, the developing device 2 is provided with a developer supply portion 7 dismountably mounted toner bottle 70. In the developing device 2, only the toner in the developer is consumed in accordance with the image formation, so that the toner content TD of the developer decreases. The developer supply portion 7 supplies an amount of new toner corresponding to the toner amount consumed by the developing device 2, from the toner bottle 70 into the developing device 2, so that the toner content TD of the developer is maintained within a predetermined range.

As shown in FIG. 3, the toner bottle 70 is provided with a lower toner feeding screw 72 and an upper toner feeding screw 71. The lower toner feeding screw 72 and the upper toner feeding screw 71 are connected with each other by gears and are driven by a supplying motor 73 and are simultaneously rotated. The upper toner feeding screw 71 supplies the toner in the upper portion of the toner bottle 70 to the lower toner feeding screw 72. The lower toner feeding screw 72 supplies the toner into the developing device (2, FIG. 2) through a supply opening 75.

The controller 100 detects the toner supply amount fed into the developing device 2 (FIG. 2) by the lower toner feeding screw 72, for each full-rotation on the basis of the output of a rotation sensor 74. By one full-rotation of the supplying motor 73, the amount of the toner corresponding to one pitch of the lower toner feeding screw 72 is supplied into the developing device (2, FIG. 2).

The toner bottle sensor 76 provided on the developer supply portion 7 detects an upper part of the toner bottle 70 to output a detection signal indicative of presence or absence of the toner bottle 70. The controller 100 discriminates on the basis of the output of the toner bottle sensor 76 as to whether to remove the currently set toner bottle 70 and replace a toner bottle 70.

(Toner Supply Control)

As shown in FIG. 2, for each one sheet of image development, the corresponding amount of the developer is taken out of the developing device 2 with the result of decrease of the toner ratio (toner content TD) of the developer circulating in the developing device 2. The controller 100 determines the toner consumption amount for each one sheet image, and supplies the corresponding amount of the toner from the toner bottle 70 into the developing device 2. The controller 100 which is an example of the toner consumption detecting means calculates a video count Vc from the image information of the one sheet image, and a coefficient A (Vc) is multiplied to the video count Vc to determine a video count supply amount M (Vc) corresponding to the toner amount consumed by the one sheet image formation. The video count Vc changes with the image ratio of the image to be formed. The video count Vc when an image having the image ratio of 100% (highest density image over the whole surface) on one sheet is Vc=1023. The image ratio of 100% means that the black toner image is formed on the entire surface of the recording material without gaps. The video count Vc changes with the image ratio of the one sheet image.

$$M(Vc)=Vc\times A(Vc) \quad (1)$$

However, the toner consumption amount determined for each one sheet image involves error, which may be accumulated with the result of gradual departure of the toner content TD of the developer from the initial value and the possible result of improper value at the end. For example, when the toner content TD of the developer decreases, the toner charge amount increases with the result of decrease of the image density even if the same electrostatic image is developed.

In view of this, the controller 100 which is an example of the supply controller uses an inductor sensor 26 to actually detect the toner content TD of the developer circulating in the developing device 2. And, it adjusts the toner amount supplied from the developer supply portion 7 into the developing device 2 so that the toner content TD of the developer approaches 8%, which is an example of a first reference value of the toner content. The controller 100 corrects the amount of the toner supplied in accordance with the toner consumption amount so as to keep the 8.0% of the toner content TD of the developer, thus keeping the constant toner content TD of the developer at the initial value.

As shown in FIG. 2, the inductor sensor 26 is provided on the wall surface of the stirring chamber 211 of the developing device 2. The inductor sensor 26 detects a magnetic permeability of the developer fed in the stirring chamber 211 and produces a output corresponding to the toner content of the developer. The controller 100 discriminates the toner content TD (Indc) of the developer on the basis of the output of the inductor sensor 26.

The controller 100 determines the toner content TD (Indc) of the developer before the toner supply for the Nth sheet, from the output of the inductor sensor 26 in the image formation for the (N−1)th sheet. The controller 100 multiplies a coefficient A (Indc) to a difference between the detected toner content TD (Indc) and the target toner content TD (target) to determine the inductor supply amount M (Indc).

$$M(Indc)=(TD(\text{target})-TD(Indc))\times A(Indc) \quad (2)$$

In this equation, the coefficients A(Vc) and A(Indc) are stored in a ROM 102 as fixed values, and the target toner content TD(target) is variably stored in a RAM 103.

The toner supply amount M per one sheet image is a sum of the video count supply amount M(Vc), the inductor supply amount M(Indc) and a remainder supply amount M(remain). The remainder supply amount M(remain) is a supply amount which has not been able to be supplied by the one full-rotation of the lower toner feeding screw 72 in the image forming operation for the (N−1)th sheet image and which is less than the amount corresponding to one full-rotation. When the result of the calculation indicates that toner supply amount M<0, the toner supply amount M=0.

$$M=M(Vc)+M(Indc)+M(\text{remain}) \quad (3)$$

Then, the determined toner supply amount M is divided by a unit supply amount T per one-full-rotation of the lower toner feeding screw 72 to determine the number of rotations B of the supplying motor 73. The unit supply amount T is stored in the ROM 102 as a fixed value.

$$B=M/T \quad (4)$$

In the image forming operation for the Nth sheet image, the supplying motor 73 is rotated by the number B of rotations calculated by the equation (4). All digits to the right of the decimal point of the number of B are discarded, and the toner supply amount corresponding to the digits is the above-described remainder supply amount M(remain).

$$M(\text{remain})=M-B\times T \quad (5)$$

(Discrimination of the Toner Bottle Remaining Amount)

As shown in FIG. 2, when the toner bottle 70 becomes empty, the toner supply from the developer supply portion 7 stops while the toner consumption continues in the developing device 2, and therefore, the toner content TD of the developer in the developing device 2 becomes lower than the target toner content TD (target).

The controller 100 discriminates the emptiness of the toner bottle 70 when a difference ΔTD(old) between the actually detected toner content TD (Indc) and the target toner content TD(target) is a reference value (−1% or less) continuously in three sheet image formations. The condition in which the toner remains in the toner bottle 70 is expressed as follows:

$$\Delta TD(\text{old})=TD(Indc)-TD(\text{target})\geq -1.0\% \quad (6)$$

When the emptiness of the toner bottle 70 is discriminated, the controller 100 displays a message "Exchange the toner bottle" on a display screen 300 of an operation panel and stops the image forming operation. When the emptiness of the toner bottle 70 is discriminated, the image forming operation is immediately stopped, and a toner bottle exchange instructions "Exchange the toner bottle" is displayed on the display screen 300.

(Toner Bottle Exchange Discrimination)

In the state that the toner bottle exchange requirement instructions is displayed on the display screen 300, the controller 100 discriminates dismounting and re-mounting of the toner bottle 70 on the basis of the output of the toner bottle sensor 76. When the toner bottle 70 is removed from the developer supply portion 7, the toner bottle sensor 76 does not detect the toner bottle 70, and "No toner bottle" is displayed on the display screen 300. When the toner bottle 70 is inserted into the developer supply portion 7 thereafter, the toner bottle sensor 76 detects the toner bottle 70, and "Toner bottle exchange is completed" is displayed on the display screen 300.

Comparison Example 1

As shown in FIG. 2, in comparison example 1, when the completion of the exchange of the toner bottle 70 is discriminated, the controller 100 automatically carries out the sequential operations in the supplying mode. In the supplying mode, the inductor supply amount M(Indc) is determined on the basis of the output of the inductor sensor 26 in this state that the image formation is interrupted. The supplying motor 73 is operated by the number B of rotations corresponding to the inductor supply amount M(Indc), thus supplying the shortage amount of the toner into the developing device 2. When the toner content TD of the developer increases up to the target toner content TD(target) after the execution of the operation in the supplying mode, the prohibition of the image forming operation is reset to permit resumption of the image forming operation.

The control of the comparison example 1 involves a problem that the image forming apparatus 80 is not usable immediately after the exchange of the toner bottle 70. When the developing device 2 is supplied with a large amount of the toner in the supplying mode operation, the toner charge amount after the supplying mode operation is different from that before the supplying mode operation with the result of difference in the image density. It may be a stress on the user exchanging the toner bottle 70 that the image forming apparatus 80 is not usable in the period immediately after the exchange of the toner bottle 70. From the standpoint of the usability, it is desired that the image forming apparatus 80 is usable immediately after the change of the toner bottle 70.

Comparison Example 2

Figure 4:
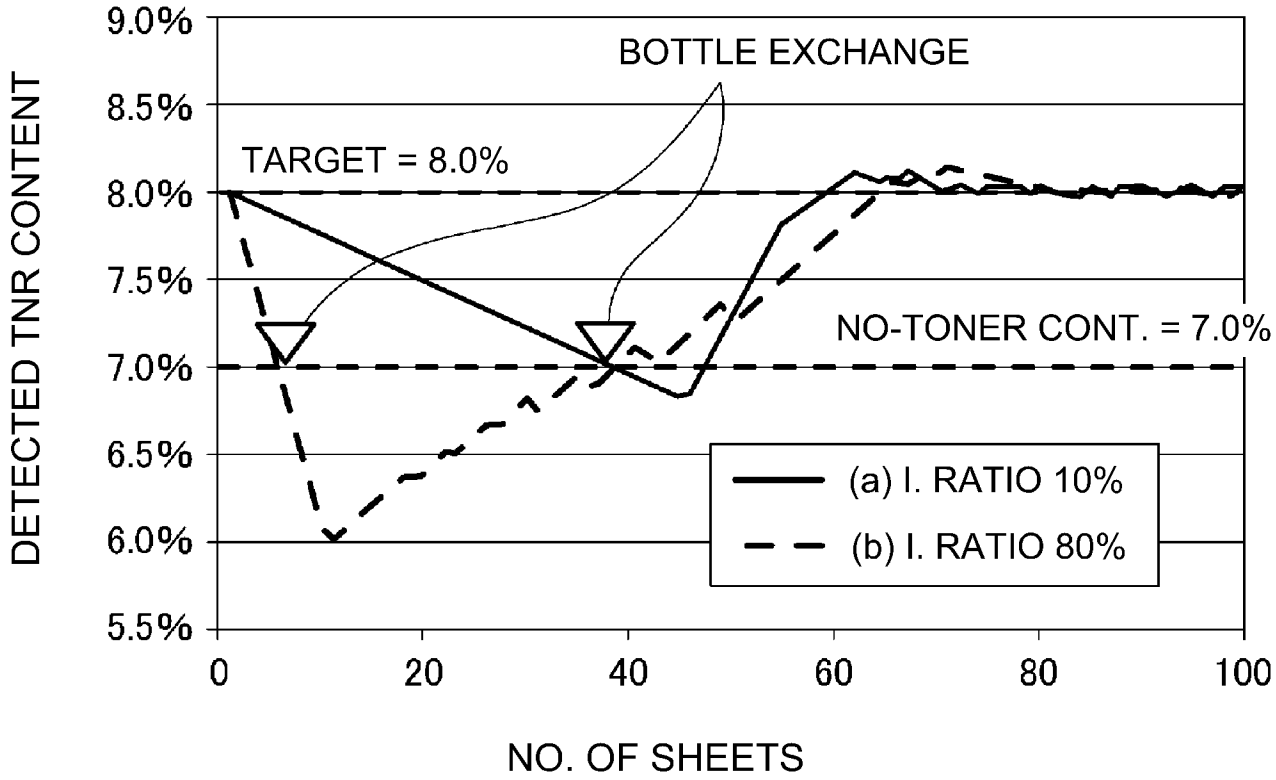
FIG. 4 shows a change of a toner content in a control in comparison example 2.

FIG. 4 shows the change of the toner content in the control of comparison example 2. In FIG. 4, line (a) (solid line) shows the case of 10% of the image ratio, and line (b) (broken line) shows the case of 80% of the image ratio. Referring to FIG. 2 and FIG. 4, in comparison example 2, when discriminating the completion of the exchange of the toner bottle, the controller 100 permits the image forming operation without the execution of the supplying mode operation.

As shown by a curve (a) in FIG. 4, the controller 100 executes the above-described toner supply control with the target toner content TD(target) setting=8.0%, and when the actually detected toner content TD(Indc) is lower than 7%, the emptiness of the toner bottle is discriminated. When the actually detected toner content TD(Indc) becomes a lower than 7%, and difference value $\Delta TD(old) \leq -1\%$, the controller 100 prohibits the image formation and displays the toner bottle exchange requirement instructions on the display screen 300. For the convenience of the explanation, it is assumed that the toner bottle 70 is replaced with a new bottle and the timing indicated by ∇ in FIG. 4.

As indicated by the curve (a) in FIG. 4, in the case of the image ratio of 10%, the actuality detected toner content TD(Indc) slightly lowers after the exchange of the toner bottle 70, but thereafter, the toner supply is quick enough to recover the target toner content TD(target), so that no problem arises. In an ordinary use of the image forming apparatus in a business office environment, the image ratio of the output image is not more than 10%, and therefore, no operation of the supplying mode sequence for recovering the toner content TD is not the problem in many cases.

However, as indicated by the curve (b) in FIG. 4, in the case of the image ratio of 80%, the actually detected toner content TD(Indc) significantly lowers after exchange of the toner bottle, and a long time is required to recover the target toner content TD(target). In the case of the two component developer, if the image forming operation is carried out under the condition of the toner content TD, the carrier tends to transfer onto the photosensitive drum 13, which is not preferable. In the case of the user frequently printing with high image ratio, no execution of the supplying mode operation results in too low toner content TD of the developer with a higher possibility. Even in the ordinary business office environment, if the output images with high image ratio are continuously printed immediately after the exchange of the toner bottle 70, incidentally, the toner content TD of the developer may become too low.

Therefore, the control of comparison example 2 involves the problem that even if a new toner bottle 70 replaces, the toner supply from the toner bottle 70 is not quick enough with the result of significant decrease of the toner content TD of the developer in the developing device 2 if images requiring a large amount of the toner consumption are printed.

Comparison Example 3

Figure 5:
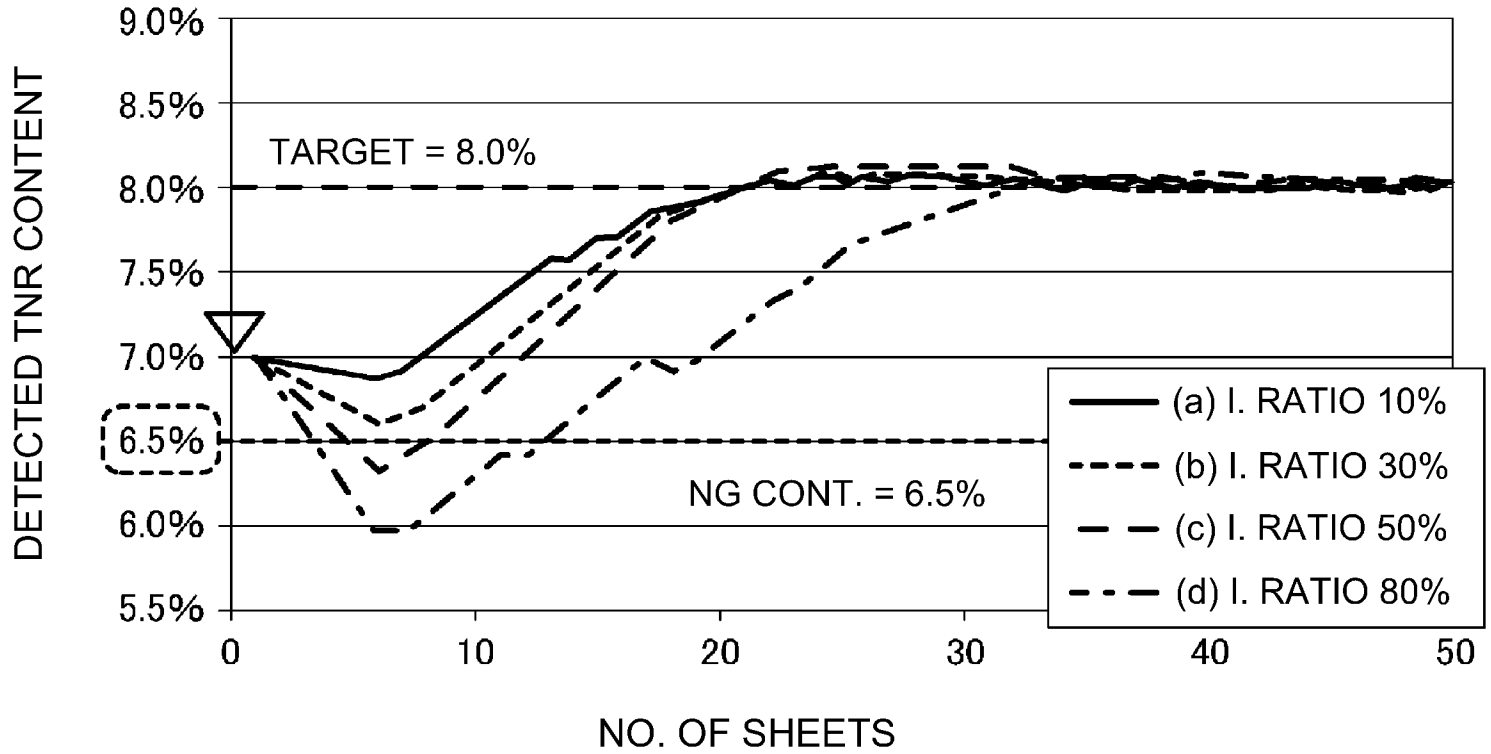
FIG. 5 shows a relationship between a number of image formations and an amount of decrease of the toner content.

FIG. 5 illustrates the relationship between the number of image formations and the decreased amount of the toner content. In FIG. 5, line (a) shows the case of the image ratio of 10%, line (b) shows the case of the image ratio of 30%, (c) shows the case of the image ratio of 50%, and line (d) shows the case of the image ratio of 80%. Referring to FIG. 2 and FIG. 5, in comparison example 3, when discriminating the exchange of the toner bottle 70, the controller 100 permits the immediate image forming operation without executing the operation in the supplying mode. When the actually detected toner content TD(Indc) becomes lower than the reference value during the image forming operation, the image forming operation is immediately interrupted, and the supplying mode operation is carried out.

As shown in FIG. 5, it is assumed that since the toner content TD of the developer lowers to 7.0% which does not satisfy equation (6), the toner bottle 70 is replaced at the timing indicated by ∇, and after the replacement, the image forming operation is resumed without execution of the supplying mode operation. In the case of the image ratio of 10% indicated by line (a), the toner supply from the new toner bottle 70 is in time, and therefore, the actually detected toner content TD(Indc) recovers to 8% without lowering beyond 6.5%. Therefore, no problem of too low toner content TD of the developer arises. For this reason, it is unnecessary to carry out the supplying mode control in the case of the image ratio of 10%.

However, if the image ratio is higher after the resumption of the image forming operation, the decrease of the actually detected toner content TD (Indc) is larger, and therefore, a longer time is required for the actually detected toner content TD(Indc) to recover. In the cases of the image ratio of 50% indicated by the line (c) and the image ratio of 80% indicated by the line (d), the actually detected toner content TD(Indc) lowers significantly beyond 6.5%, with the result of too low toner content TD of the developer. For this reason, when the image forming operation is carried out with the image ratio of 50% and the image ratio of 80% after the exchange of the toner bottle 70, the supplying mode operation is to be carried out.

When the necessity of the operation in the supplying mode is discriminated in the control of comparison example 3, the frequency of the operations in the supplying mode increases if an attempt is made to assure the prevention of the occurrence of too low toner content TD of the developer. This is because when the image forming operation with high image ratio is continuously carried out after the exchange of the toner bottle 70, the decreasing speed of the actually detected toner content TD (Indc) is high, and therefore, the reference value on the basis of which the necessity of the execution of the supplying mode operation has to be set to be high.

In view of the foregoing, in the following embodiment, when the output images having the high image ratios continue after the exchange of the toner bottle 70, the sequence operation in the supplying mode is carried out, whereas the output images having the low image ratios continue, the sequence operation in the supplying mode is omitted.

Control in Embodiment 1

Figure 6:
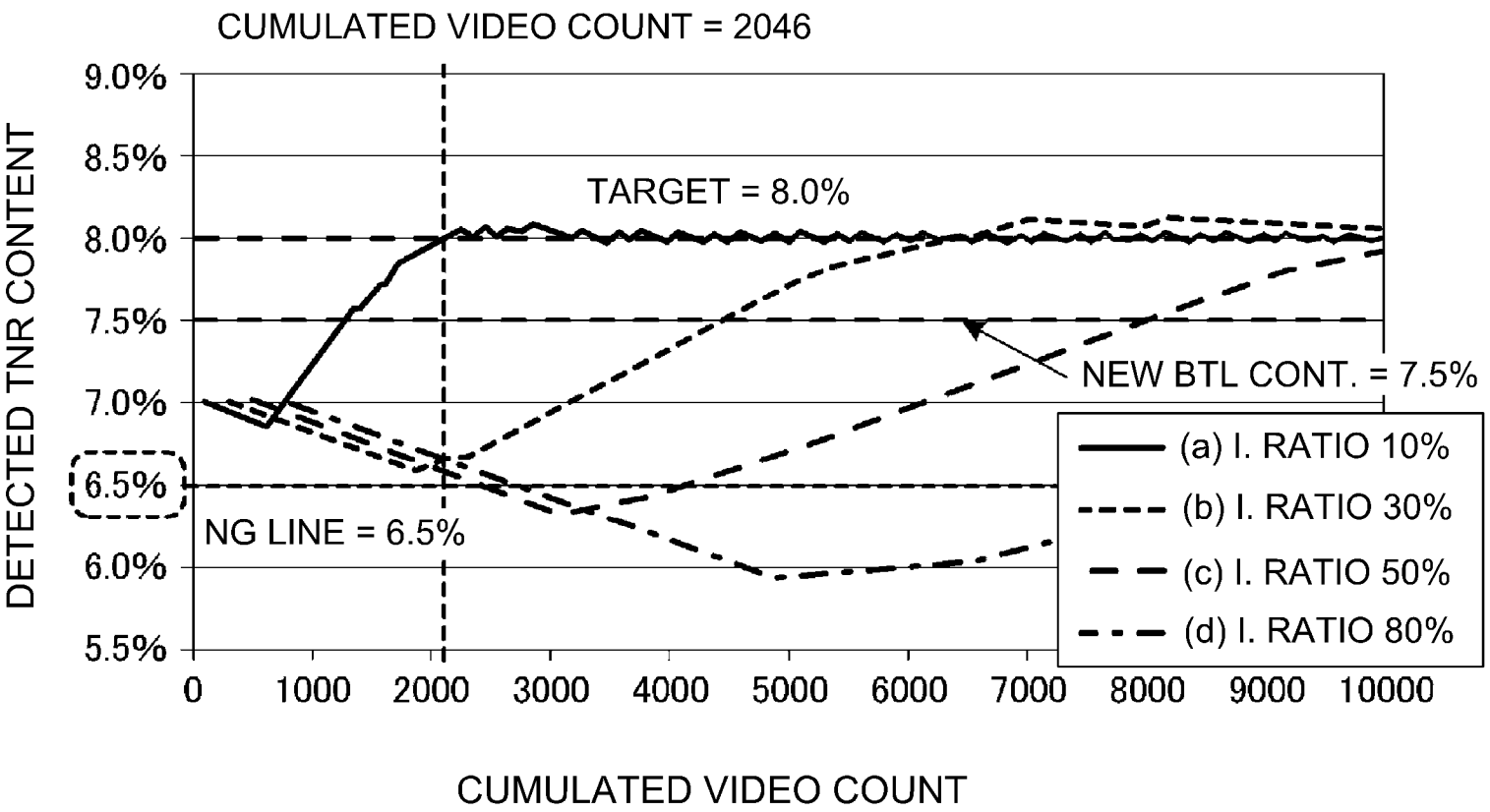
FIG. 6 shows a relationship between a video count cumulated value and an amount of decrease of the toner content.
Figure 7:
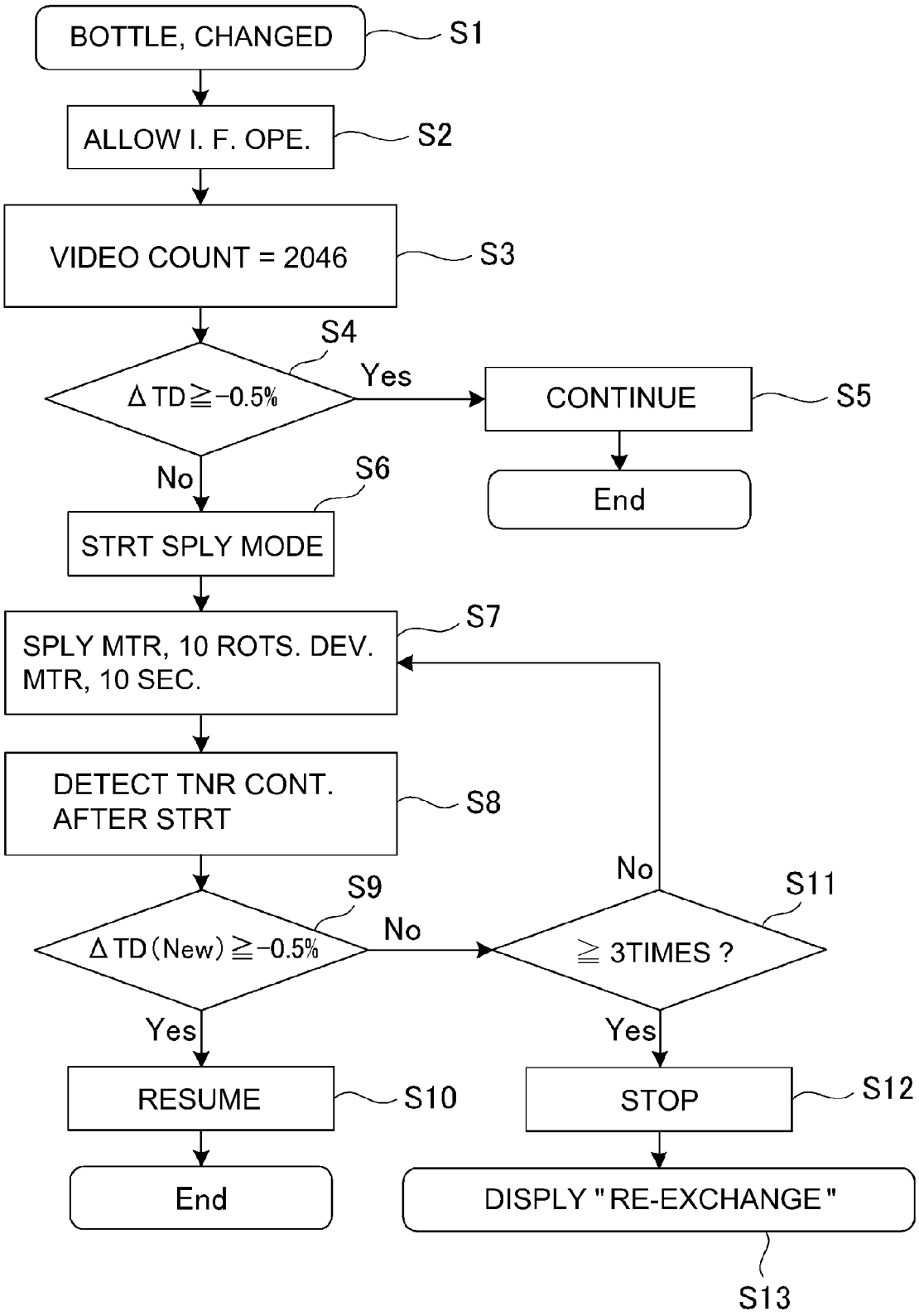
FIG. 7 is a flow chart of a control according to Embodiment 1.
Figure 8:
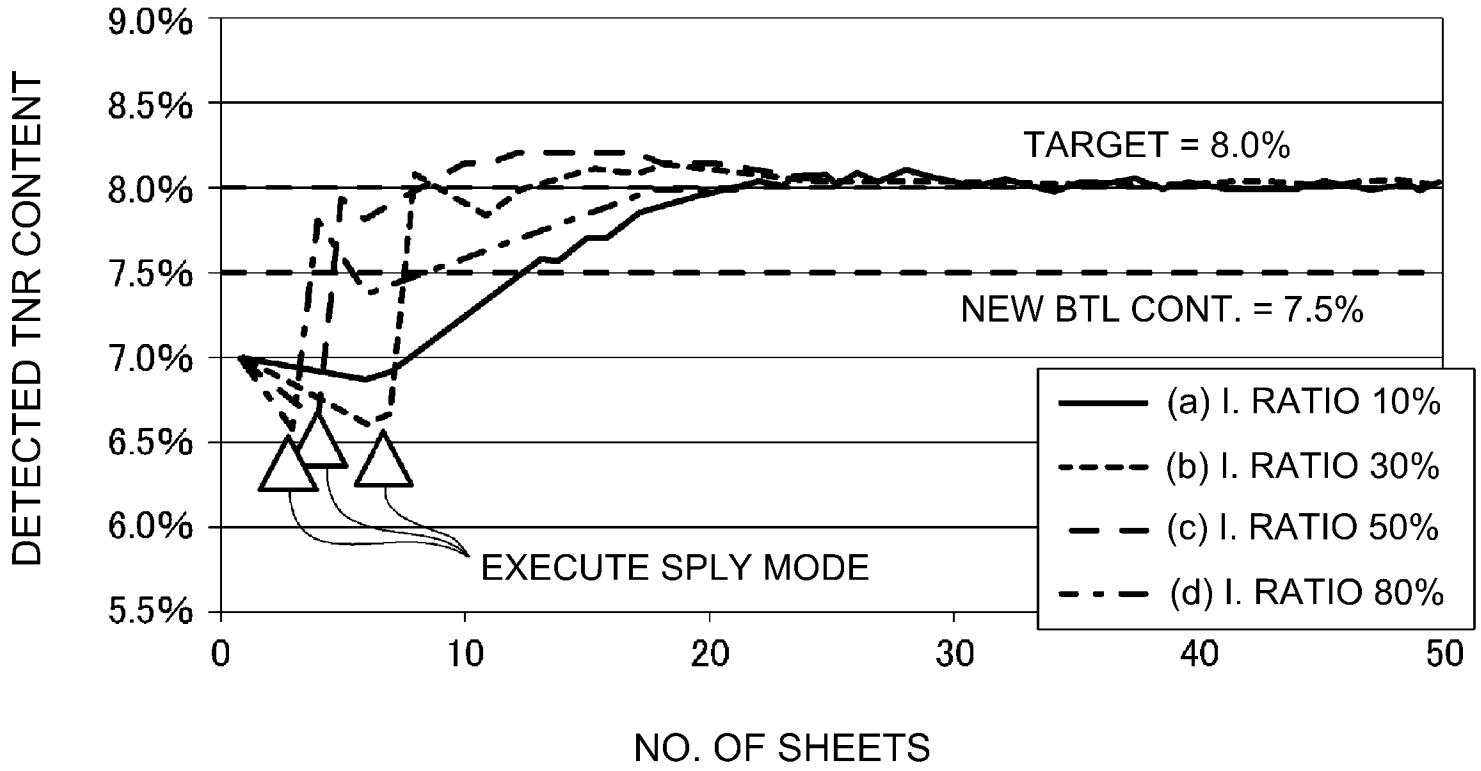
FIG. 8 shows an effect of the control of Embodiment 1.

FIG. 6 shows a relationship between the video count cumulated value and the decrease amount of the toner content. FIG. 7 is a flow chart of the control in Embodiment 1. FIG. 8 shows the effects of the control of Embodiment 1. In FIGS. 6, 8, line (a) shows the case of the image ratio of 10%, line (b) shows the case of the image ratio of 30%, line (c) shows the case of the image ratio of 50%, and line (d) shows the case of the image ratio of 80%.

As shown in FIG. 2, in Embodiment 1, in the normal image formation, the image forming operation is prohibited when the toner content of the developer is lower than the first threshold which is lower than the reference value, on the basis of the results of the direction of the toner content in the developing device. When the detection result by the inductor sensor 26 is lower than the first threshold, the image forming operation is prohibited. When the predetermined condition is reached after the prohibition of the image forming operation, it is determined whether to prohibit the image forming operation on the basis of the second threshold which is higher than the first threshold.

The controller 100 which is an example of the controller prohibits the image forming operation on the basis of the detection result of the inductor sensor 26. The controller 100 prohibits the image forming operation when the toner content in the developing device becomes lower than the first threshold which is lower than the predetermined reference value 8.0%.

The toner bottle sensor 76 which is an example of the exchange detecting means detects the information for discriminating whether or not the toner bottle 70 exchanging operation has been carried out. The controller 100 releases the prohibition on the basis of the detection result of the toner bottle sensor 76, and thereafter permits the image forming operation respective of the detection result of the inductor sensor 26 before the predetermined condition is reached. Here, the period "before the predetermined condition is reached" means the period after the releasing of the prohibition of the image forming operation and before the amount of the consumed toner reaches a predetermined amount. In the case that the image forming operation is permitted after the toner bottle 70 exchanging operation, the supply control is carried out in the same manner as in the normal image forming operation. That is, the supply control is carried out on the basis of the video count supply amount M(Vc), the inductor supply amount M(Indc) and the remainder supply amount M(remain).

The controller 100 which is an example of the toner detecting means is capable of detecting the cumulated value Vsum of the video count as the information corresponding to the toner consumption amount with the image formations. When the exchanging operation of the toner bottle 70 is carried out, the controller 100 releases the prohibition of the image forming operation until the cumulated value Vsum reaches the predetermined toner consumption amount.

The controller 100 determines whether to prohibit the image forming operation on the basis of the detection result of the inductor sensor 26 at the time when the cumulated value Vsum is reached. When prohibiting the image forming operation on the basis of the detection result of the inductor sensor 26 at the time when the cumulated value Vsum is reached, the controller 100 effects the operation in the supplying mode in which the developer supply portion 7 is operated for a predetermined time period in the state that the image forming operation is prohibited. When the toner content in the developing device is lower than the second threshold 7.5% which is higher than the first threshold 7.0%, the controller 100 effects the operation in the supplying mode to supply the reservoir developer into the developing device 2. However, if the toner content in the developing device is not less than the second threshold (not less than 7.5%), the controller effects the supply of the reservoir developer into the developing device 2 under the normal control, without effecting the operation in the supply mode and without prohibition of the image forming operation.

The threshold 7.5% for determining whether to prohibit the image forming operation (execution of the supplying mode operation) is higher than the threshold 7.0% for determining whether to prohibit the image forming operation as a result of the detection of the emptiness of the toner bottle 70. If the toner content in the developing device after the execution of the supplying mode operation is less than the threshold 7.5%, the controller 100 effects the repeated operation in the supplying mode, and if the toner content in the developing device is less than the threshold 7.5% even after the execution of a number of predetermined times of the supplying mode operations, the controller 100 orders the re-exchange of the toner bottle 70.

FIG. 6 is similar to FIG. 5, but the abscissa is replaced with the cumulated value of the video count Vc after the exchange of the toner bottle 70 from the cumulative number of image formations after the exchange of the toner bottle 70, with respect to the (a)-(d). As shown in FIG. 6, the image formation is started in the state of the toner content TD(Indc) of 7.0% after the change of the toner bottle 70. At this time, the inclination of the lowering toner content TD(Indc) actually detected relative to the cumulated value of the video count Vc is substantially the same irrespective of the image ratios of the image formation after the exchange of the toner bottle 70. The lowest value of the toner content TD as a result of the toner supply after the exchange of the toner bottle 70 decreases with increase of the image ratio.

Therefore, until the cumulated value of the video count Vc reaches 2046 after the exchange of the toner bottle 70, the image forming operation is permitted without execution of the supplying mode operation, unconditionally. By doing so, it can be avoided that the toner content TD becomes lower than the NG line 6.5%, irrespective of the image ratio, after the exchange of the toner bottle 70.

The supplying mode is carried out, if the toner content TD(Indc) actually detected immediately before the cumulated value of the video count Vc reaches 2046 is lower than the second threshold 7.5% for discriminating whether to execute the supplying mode operation. In this embodiment, in the case of the print ratio of 100%, the video count Vc=1023, and therefore, at least one sheet can be printed irrespective of the print ratio.

As shown in FIG. 6, the reference value is 8.0%, the first threshold is 7.0%, and the second threshold is 7.5% in Embodiment 1. The cumulated value 2046 of the video count Vc which is an example of the predetermined value is set as follows. It is determined corresponding to the cumulative amount of the toner consumption amount immediately before the toner content becomes lower than the NG line when the image forming operation with the maximum toner consumption amount is continued after the exchange of the toner bottle 70. In FIG. 6, the new bottle discriminating toner content of 7.5% is the threshold for discriminating whether to execute the supplying mode operation.

In the supplying mode operation, the image forming operation is prohibited, and therefore, no further decrease of the toner content TD occurs, and it can be avoided assuredly that the toner content TD is lower than the NG line of 6.5%, under which the image forming operation is carried out.

Referring to FIG. 2 and FIG. 7, in the image forming operation in a first mode, the controller 100 discriminates whether to execute the supplying mode operation which is an example of a second mode operation, on the basis of at least the input image information and the detection result of the inductor sensor 26. In the supplying mode operation, the image forming operation is prohibited again, and the supplying operation by the developer supply portion 7 is carried out.

If the toner content in the developing device at the time when the cumulative amount of the toner consumption amount for each image formation on the basis of the input image information reaches a predetermined value, so that the predetermined toner consumption amount is reached, the controller 100 executes the supplying mode operation which is an example of the second mode operation. In the supplying mode, the reservoir developer is supplied into the developing device 2, while prohibiting the image forming operation. However, it does not prohibit the image forming operation when the toner content of the developer at the time when the predetermined toner consumption amount is reached is not less than 7.5% which is an example of the second threshold higher than the first threshold.

When the toner bottle 70 is exchanged (S1), the controller 100 permits the resumption of the image forming operation without executing the supplying mode operation (S2). The controller 100 cumulates the video count Vc first sheet, and the above-described toner supply control is carried out. Simultaneously, it determines the cumulated value Vsum of the video count resulting from the image formations after the exchange of the toner bottle 70 and waits for the cumulated value Vsum to reach 2046.

When the cumulated value Vsum reaches 2046, the controller 100 checks the toner content TD(Indc) actually detected in the image forming operation immediately before, and discriminates whether to execute the supplying mode operation. For example, when the cumulated value Vsum reaches 2046 at (N+1)th print, it is discriminated whether or not the difference value ΔTD between the toner content TD(Indc) actually detected in the image forming operation for the Nth print and the target toner content TD(target) satisfies the inequality (7) (S4).

$$\Delta TD = TD(Indc) - TD(\text{target}) \geq -0.5\% \quad (7)$$

When the inequality (7) is satisfied, the controller 100 does not effect the supplying mode operation and permits the image forming operation to continue (S5). When the inequality (7) is not satisfied, the controller 100 effects the execution of the supplying mode (S6). Simultaneously with the supplying motor 73 making ten full-rotations in the supplying mode, the development driving motor 27 is operated for ten sec (S7).

The number of rotations of the supplying motor 73 and the time period of operation of the development driving motor 27 corresponds to the time required for the amount of the toner corresponding to 2046 of the cumulated value Vsum of the video count Vc to flow into the developing device 2 after the start of the operation of the developer supply portion 7. By supplying the amount of the toner corresponding to the cumulated value Vsum=2046 of the video count Vc into the developing device 2, the toner content TD of the developer in the developing device 2 within the range of 6.5-7.5% substantially assuredly recovers to not less than 7%. In the image forming operation carried out after the supplying mode operation, the toner content TD of the developer in the developing device 2 substantially assuredly recovers to TD (target).

In the period of 9-10 seconds from the rotation start of the development driving motor 27, the controller 100 takes in the output of the inductor sensor 26 to determine the actually detected toner content TD(Indc) (S8). The controller 100 determines the difference value ΔTD(New) between the actually detected toner content TD(Indc) and the target toner content TD(target), and discriminates whether or not the following inequality (8) is satisfied.

$$\Delta TD(\text{New}) = TD(Indc) - TD(\text{target}) \geq -0.5\% \quad (8)$$

When the inequality (8) is satisfied (Yes at S9), the supplying mode of the controller 100 stops the supplying mode operation and permits the resumption of the image forming operation (S10). If, however, the toner content in the developing device after the execution of the second mode operation is less than the reference value, the second mode operation is repeated. When the inequality (8) is not satisfied (No at S9), the supplying mode operations (S7, S8) is carried out three times at the maximum (No of S11).

The controller 100 which is an example of a re-exchange requiring means requires the re-exchange of the toner bottle 70 if the toner content in the developing device is less than the second threshold despite the predetermined number of supplying mode operations, and orders the re-exchange of the toner bottle 70. When the inequality (8) is not satisfied despite three supplying mode operations (S7, S8) (Yes, S11), the controller 100 discriminates the replacement toner bottle 70 was an empty bottle, and stops the image forming operation (S12). And, it displays "Re-exchange the toner bottle" on the display screen 300 of the operation panel.

(Effects of the Control of Embodiment 1)

Referring to FIG. 2 and FIG. 8 in combination, when the image ratio is 10%, the inequality (7) is satisfied at the time when the cumulated value Vsum reaches 2046, and therefore, the control for the supplying mode it is not carried out. In the case of the image ratio of 10%, the toner content TD (Indc) can be recovered without the down time required by the control for the supplying mode.

In the cases of the image ratios of 30%, 50% and 80%, the inequality (7) is not satisfied at the time when the cumulated value Vsum reaches 2046, and therefore, the supplying mode operations are carried out at the timings indicated by ∇. As a result, the significant reduction of the actually detected toner content TD (Indc) can be avoided irrespective of the image ratio.

According to the control of Embodiment 1, the image forming apparatus is unusable only when it is necessary, in response to the cumulative amount of the toner for the images outputted after the exchange of the toner bottle 70, and therefore, the user's comfort is assured, and simultaneously, the excessive decrease of the toner content of the developer can be avoided. The execution frequency of the supplying mode operation can be minimized without increasing the risk of the excessive decrease of the toner content of the developer.

According to the control of Embodiment 1, the supplying mode operation is not carried out when the image ratio of the image formation is low after the exchange of the toner bottle 70. When the image ratio of the image formation after the exchange of the toner bottle 70 is high, the supplying mode operation is carried out to avoid the excessive decrease of the toner content of the developer.

According to the control of Embodiment 1, when the image formation with low image ratio continues after the exchange of the toner bottle 70, the toner content of the developer sufficiently recovers before the cumulated value Vsum reaches 2046, and therefore, unnecessary execution of the supplying mode operation can be assuredly avoided. Because the toner consumption amount for each image formation is taken into account, the excessive decrease of the toner content of the developer can be assuredly avoided, as compared with the case that the necessity of the supplying mode operation is discriminated only on the basis of the number of image formations after the exchange of the toner bottle 70. The excessive decrease of the toner content of the developer can be assuredly avoided, as compared with the case that the necessity for the execution of the supplying mode operation is discriminated only on the basis of the change in the output of the inductor sensor 26 after the exchange of the toner bottle 70.

According to the control of Embodiment 1, the necessity for the execution of the supplying mode operation can be correctly discriminated irrespective of the level of the toner consumption amount for each image formation. By carrying out the predetermined amount of the image formations after the exchange of the toner bottle 70, the toner consumption amount for each image formation can be correctly discriminated, and the necessity for the execution of the supplying mode operation can be discriminated. When the toner consumption amount is large, the operation in the supplying mode can be assuredly executed, because the toner content of the developer after the predetermined amount of the image formations is low. When the toner consumption amount is small, the image forming operation continues without executing the supplying mode operation, because the toner content of the developer after the predetermined amount of the image formations is high.

Modified Examples of Embodiment 1

The value of −0.5% in inequality (7) may be another value in consideration of the detection accuracy or the like over the inductor sensor 26. If the value of −0.5% in inequality (7) is too high, the implementation frequency of the supplying mode operations increases, and therefore, the value is preferably in the range of −0.8-−0.2%. The threshold of the toner content for discriminating the necessity of the execution of the second mode operation is preferably higher than the threshold of the toner content at the time of requiring the exchange of the toner bottle 70 as a result of the discrimination of the emptiness of the toner bottle 70. This is because then the possibility of erroneous discrimination as to whether or not the toner bottle 70 is new is low.

On the other hand, the value of −0.5% in inequality (8) may be another one, but it is preferably not less than −0.8% because then toner supply is assuredly discriminated in the supplying mode operation. The value of the threshold 7.0% of the toner content for discriminating the necessity for the exchange of the toner bottle 70 may be another in consideration of the target toner content.

In Embodiment 1, the timing of the exchange of the toner bottle 70 is discriminated on the basis of the output of the inductor sensor 26, but the timing may be discriminated by another means. For example, the emptiness of the toner bottle 70 may be discriminated on the basis of the detection of the weight of the toner bottle 70, or on the basis of detection of the presence or absence of the reservoir developer at the outlet of the toner bottle 70.

The number of three (S11) for discriminating the emptiness of the new toner bottle toner bottle 70 having replaced may be changed to optimize in consideration of the supplying property of the toner bottle 70.

In Embodiment 1 described in the foregoing, the necessity for the prohibition of the image forming operation is re-discriminated on the basis of the toner content at the time when the toner consumption amount reaches the predetermined amount after the exchange of the toner bottle 70, but the timing of the discrimination is not limited to this example. As long as the toner content does not become lower than the NG line after the exchange of the toner bottle 70, it will suffice if the image forming operation is permitted until the predetermined condition is reached, and the necessity for the prohibition of the image forming operation is discriminated when the predetermined condition is reached. For example, the necessity for the prohibition of the image forming operation may be re-discriminated on the basis of the toner content at the time when the drive time period of the developing sleeve in place of the toner consumption amount after the exchange of the toner bottle 70 reaches a predetermined period. Alternatively, the necessity for the prohibition of the image forming operation may be re-discriminated on the basis of the toner content at the time when a predetermined print number is reached after the exchange of the toner bottle 70. The above-described predetermined time period and the predetermined print number may be changed depending on the image amount of the image to be outputted. For example, the predetermined time period or the predetermined print number may be increased in the case of the low print ratio than in the case of the high print ratio.

Embodiment 2

Figure 9:
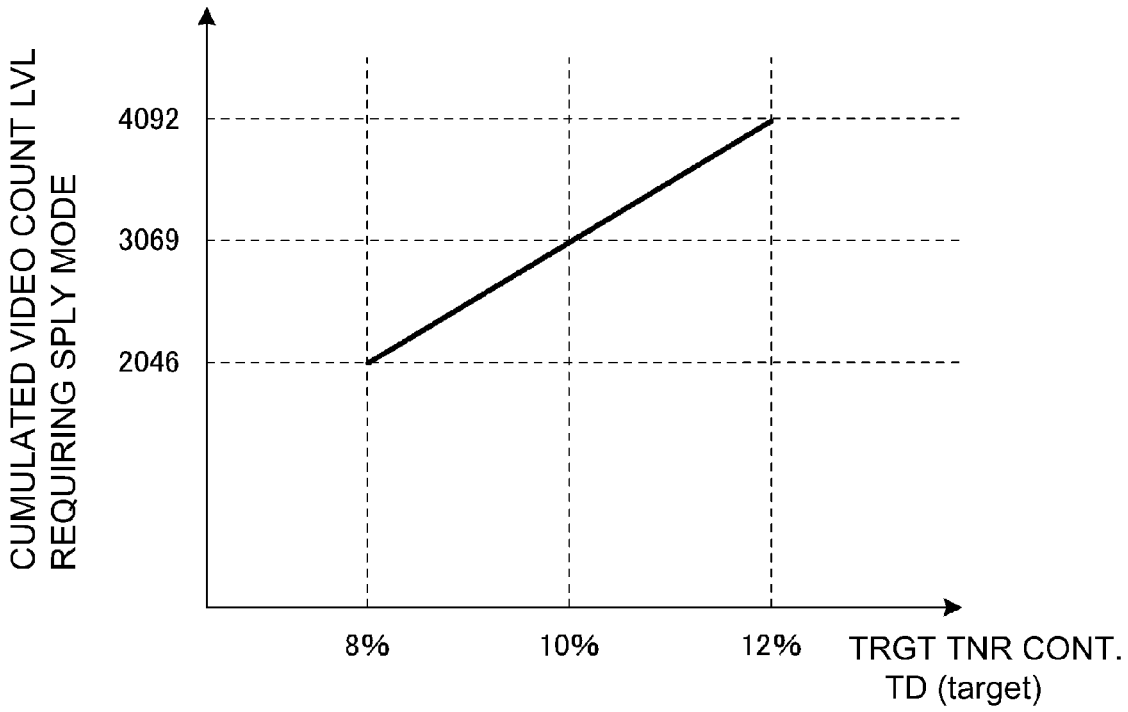
FIG. 9 is an illustration of a control according to Embodiment 2.

FIG. 9 is an illustration of the control according to Embodiment 2. In Embodiment 1, as shown in FIG. 2, the toner content TD(Indc) is actually detected after the cumulated value Vsum of the video count Vc reaches the fixed value of 2046 after the exchange of the toner bottle 70. And, the actually detected toner content TD(Indc) and the target toner content TD(target) are compared to each other to discriminate whether to execute the supplying mode operation. In Embodiment 2, as shown in FIG. 9, the cumulated value Vsum of the video count Vc at which the necessity for the execution of the supplying mode operation is changed depending on the target toner content TD(target).

As shown in FIG. 9, in Embodiment 2, similarly to Embodiment 1, when the target toner content TD(target) is 8%, the image forming operation is continued unconditionally up to the cumulated value Vsum of 2046. However, if the target toner content TD(target) is 10% which is 2% higher than in Embodiment 1, the image forming operation is continued unconditionally up to the cumulated value Vsum of 3069. When the target toner content TD(target) is 12% which is 4% higher than in Embodiment 1, the image forming operation is continued unconditionally up to the cumulated value Vsum of 4092.

That is, with the increase of the target toner content TD (target) of the developer in the developing device 2, the time period until the toner content of the developer reaches the excessive decreased level of 6.5% increases, for the image forming operation of the same toner consumption amount. Correspondingly, the time period during which the image forming operation can be carried out without the execution of the supplying mode operation after the exchange of the toner bottle 70 can be made longer assuredly. The cumulated value Vsum of the video count Vc at which the necessity for the execution of the supplying mode operation is discriminated can be selected to be larger than that (2046) in Embodiment 1. By increasing the cumulated value Vsum, the execution frequency of the supplying mode operation can be reduced, and therefore, the number of the downtime occurrences can be reduced, even when the image forming operation is continued with high image ratio.

According to the control of Embodiment 2, when the possibility of the toner content TD of the developer reaching the excessively low level of 6.5% is low, the supplying mode can be omitted so that the execution frequency of the supplying mode operation can be reduced. Even if the image forming operation is continued without the execution of the supplying mode operation until immediately before the possibility of the toner content TD of the developer lowering beyond 6.5% becomes high, the continuance of the state that the toner content TD of the developer is lower than 6.5%.

Embodiment 3

Figure 10:
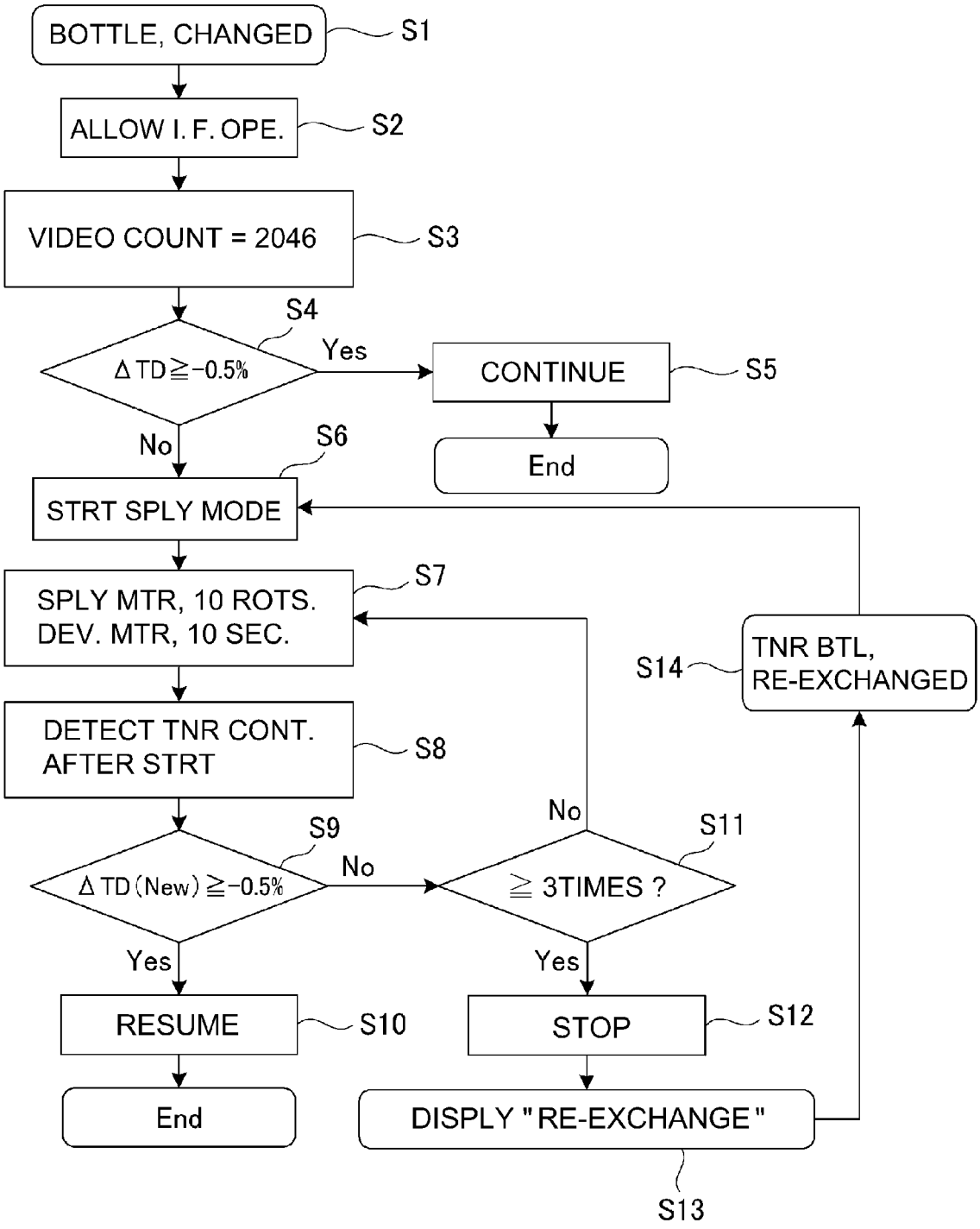
FIG. 10 is a flow chart of a control according to Embodiment 3.

FIG. 10 is a flow chart of a control according to Embodiment 3. In FIG. 10, the steps other than step S14 are the same as those of Embodiment 1, and the same reference numerals are assigned to the corresponding steps, and the description of these steps are omitted.

As shown in FIG. 2 and FIG. 10, in Embodiment 3, when the actually detected toner content TD(Indc) does not rise despite three supplying mode operations (Yes, S11), the controller 100 displays "Re-exchange the toner bottle" on the display screen 300 (S13).

In this situation of the display screen 300 displaying "Re-exchange the toner bottle", the possibility that the actually detected toner content TD(Indc) has been lowered down to the limit is high. If the image formation is permitted under the condition that the actually detected toner content TD(Indc) decreases to the limit, the possibility that the actually detected toner content TD(Indc) lowers beyond the limit and the carrier is transferred onto the photosensitive drum 13 is high.

Therefore, when the "Re-exchange the toner bottle" is displayed on the display screen 300, and the toner bottle 70 is exchanged (S14), the controller 100 executes the supplying mode operation unconditionally, thus avoiding the further decrease of the toner content TD(Indc) (S6).

As shown in FIG. 3 and FIG. 10, when discriminating the exchange of the toner bottle 70 depending on the output of the toner bottle sensor 76, the controller 100 executes the supplying mode operation in the state that the image forming operation is interrupted. By doing so, even when an empty bottle is inadvertently mounted, the situation that the toner content of the developer continues to be lower than 6.5% can be avoided.

Embodiment 4

In Embodiment 1, the image forming operation is permitted irrespective of the toner content before the toner consumption amount reaches the predetermined amount at the image formation resumption, on the basis of the toner bottle exchange detection result. And, on the basis of the toner content at the time when the toner consumption amount after the exchange of the toner bottle reaches the predetermined amount, the necessity for the prohibition of the image forming operation is discriminated again. In Embodiment 4, the image forming operation is prohibited on the basis of the toner content and a threshold within a predetermined period after the image formation resumption, and the threshold is changed on the basis of an average of the image ratio during a predetermined period.

More particularly, the threshold is higher when the average of the image ratio is higher than when it is lower. By doing so, the decrease of the toner content in the developing device beyond a tolerable range can be avoided, and the increase of the down time by unnecessary prohibition of the image forming operation can be reduced.

Further particularly, the threshold is changed as follows.

(1) in the case of the average of the image ratio being not less than 80%, the threshold is 6.9%.

(2) in the case of the average of the image ratio is not less than 20% and less than 80%, the threshold is 6.7%.

In the case of the average of the image ratio being less than 20%, the threshold is 6.5%.

In Embodiment 4, with the increase of the image ratio in a predetermined period in the image forming operation resuming in response to the bottle exchange detection result, the threshold at which the necessity for the prohibition of the image forming operation is discriminated increases. Therefore, when the image forming operation is continuously carried out with a high image ratio, the image forming operation is prohibited in a sooner stage, whereas when the image forming operation is not continuously carried out with the high image ratio, the image forming operation is not unnecessarily prohibited.

The predetermined period in this embodiment is the period until the toner consumption amount reaches the predetermined amount, similarly to Embodiment 1. As described hereinbefore, the parameter (toner consumption amount) for determining the timing of the discrimination may be replaced with a predetermined print number, or a predetermined drive period of the developing sleeve.

OTHER EMBODIMENTS

A part or all of the structures of the foregoing embodiments may be replaced with alternative structure or structures, as long as the image forming operation is continued without executing the supplying mode operation before the cumulative amount of the toner consumption reaches a predetermined cumulative amount after the exchange of the developer container.

The present invention is applicable to a developing device, a process cartridge in the image forming apparatus using a two component developer, irrespective of the charging type, transfer type or the fixing type. The dimensions, the materials, the configurations, the positional relationships of the constituent elements and so on in the Embodiments 1-3 are not restrictive to the present invention. In the foregoing description, the major parts relating to the toner image formation/transfer are described, but the present invention is applicable to Various devices such as various printers, copying machines, facsimile machines, multifunction machines, and so on by employing casing structures.

The detecting means may be another means capable of detecting information relating to the toner content in the developing device. For example, it may be detected using a patch sensor. The input image information may be video count of the exposure device, or average image ratio information of the image data.

The discrimination whether to execute the supplying mode may be made on the basis of a toner content TD change rate (inductor change rate) calculated from a plurality of toner contents TD(Indc) acquired by the inductor sensor 26 in the neighborhood of the predetermined cumulative amount of the toner consumption.

The target toner content TD(target) may be changed manually through the display screen of the operation panel and/or a display screen of an external personal computer. A patch image may be formed on the photosensitive drum 13 during a non-image-formation period, and a toner deposition amount of the patch image is measured, and the target toner content may be of much college changed in accordance with the result of the measurement.

The bottle exchange detecting means may be any of various means with which the controller is capable of detecting the information for discriminating whether or not the developer container exchanging operation has been carried out. For example, the toner bottle 70 may be provided with a tag memory element full discrimination of the freshness or a resistance element which is disconnected by electric energy supply, and the completion of the exchange of the toner bottle 70 may be discriminated on the basis of the detection signal acquired from such an element. A toner bottle exchange door may be provided with an opening and closing sensor, and the completion of the exchange of the toner bottle 70 may be discriminated on the basis of the detection of the opening and closing operation. In the state that the toner bottle 70 exchange requirement is displayed, "Has toner bottle been exchanged" may be displayed on the display screen 300, and the completion of the toner bottle may be discriminated by the user depressing an OK button.

In addition, the emptiness of the toner bottle may be discriminated on the basis of the event that the recovery of the toner content is confirmed when the toner content TD(Indc) is actually detected after ten second operations of the supplying motor 73 and the development driving motor 27 after the exchange of the toner bottle 70.

Comparison Example 1

Figure 11:
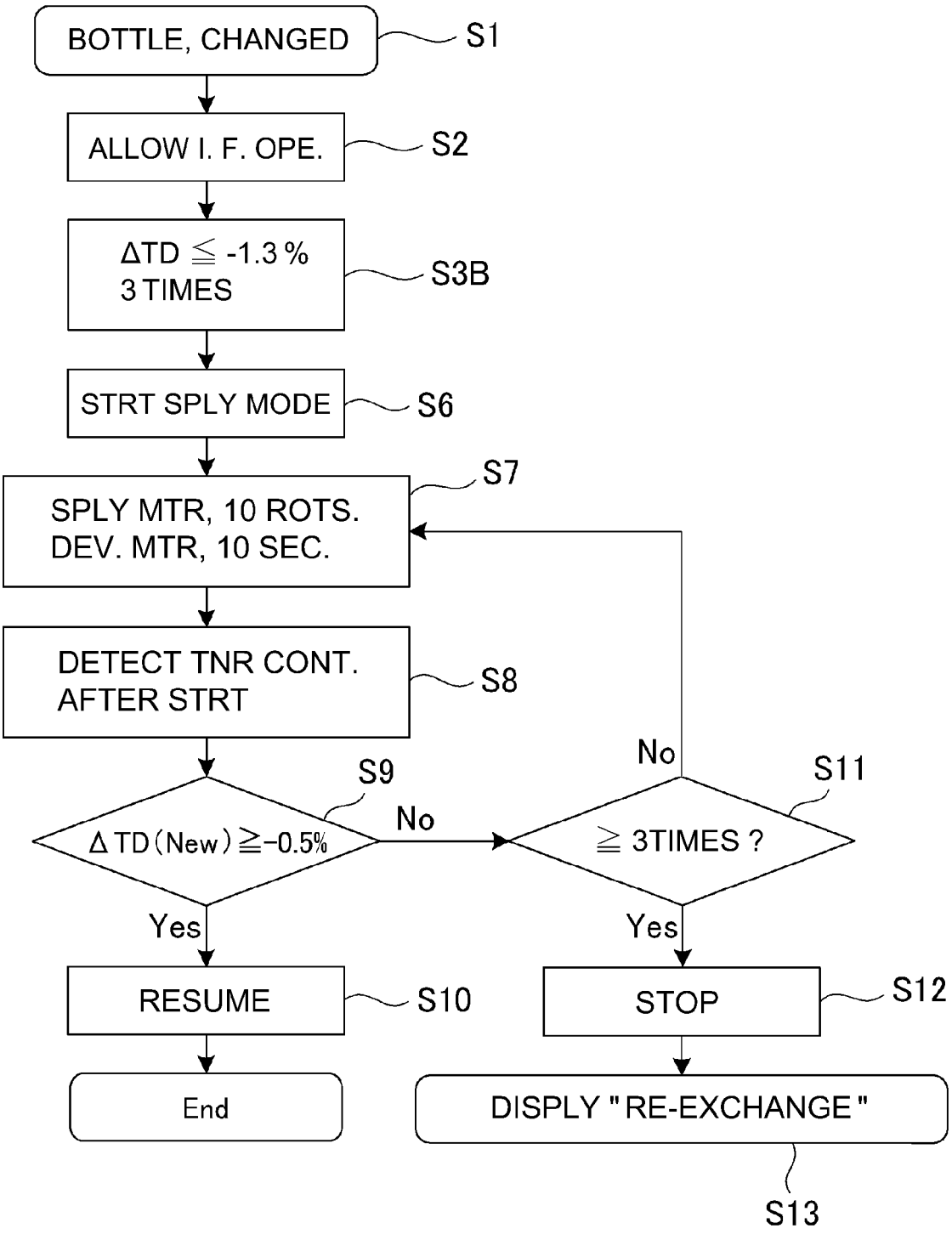
FIG. 11 is a flow chart of a control in a reference example 1.

FIG. 11 is a flow chart of a control of comparison example 1. FIG. 8 shows the effects of the control of Embodiment 1. In FIG. 5, line (a) shows the case of the image ratio of 10%, line (b) shows the case of the image ratio of 30%, (c) shows the case of the image ratio of 50%, and line (d) shows the case of the image ratio of 80%.

In Embodiments 1, 2 and 3, when the cumulated value Vsum of the video count reaches the predetermined value, the necessity for the execution of the supplying mode operation is discriminated on the basis of the value of the actually detected toner content TD(Indc). On the contrary, in comparison example 1, the necessity for the execution of the supplying mode operation is discriminated only on the basis of the actually detected toner content TD(Indc).

Referring to FIG. 2, comparison example 1 does not use the video count Vc, and various discriminations are made on the basis of the toner content TD (Indc) actually detected by the inductor sensor 26.

(A) target toner content TD(target): 8.0%

(B) exchange discrimination toner content TD(old): 7.0%

(C) recovery discrimination toner content TD(mode): 6.7%

New bottle discrimination toner content TD(new): 7.5%.

(a) similarly to Embodiment 1, the controller 100 adjusts the toner amount supplied from the developer supply portion 7 into the developing device 2 so as to maintain the toner content of the developer in the developing device 2 at the target toner content TD(target)=8.0%.

(b) similarly to Embodiment 1, when the toner content of the developer in the developing device 2 lowers to the exchange discrimination toner content TD(old)=7.0%, the controller 100 discriminates the emptiness of the toner bottle to request the "Exchange of the toner bottle".

(c) as is different from Embodiment 1, when the toner content of the developer in the developing device 2 is less than the recovery discrimination toner content TD(mode)=6.7% continuously three times, the controller 100 prohibits the image forming operation and carries out the supplying mode operation.

Similarly to Embodiment 1, in the execution of the supplying mode operation, the controller 100 stops the supplying mode operation and, the image forming operation, when the toner content of the developer in the developing device 2 recovers to the new bottle discrimination toner content TD(new)=7.5%.

Referring to FIG. 2, as shown in FIG. 11, when discriminating the emptiness of the toner bottle 70 as in (b), the controller 100 displays "Exchange toner bottle" on the display screen 300 to prohibit the image forming operation. Similarly to Embodiment 1, when the toner bottle is exchanged (S1), the image forming operation is permitted without the execution of the supplying mode operation (S2).

After the start of the image forming operation, the controller 100 stores in the memory 103 the continuous three data of the actually detected toner content TD(Indc) by the inductor sensor 26, and the memory 103 is renewed sequentially. When all of the three data of the toner content TD(Indc) in the memory 103 become lower than the target toner content TD(target) by not less than 1.3%, the discrimination of (c) be made, and execute the supplying mode operation (S6).

More particularly, the discrimination is made as to whether or not the difference value ΔTD(N) between the actually detected toner content TD(Indc) and the target toner content TD(target) in the Nth printing operation, satisfies the following continuously three times. If the discrimination is made only on the basis of the data for one printing operation, the influence of the detection error of the inductor sensor 26 is so large that the discrimination of the necessity of the operation of the supplying mode may be erroneous.

$$\Delta TD(N)=TD(Indc)-TD(\text{target})\leq -1.3\% \quad (10)$$

When the inequality (10) is satisfied (S3B), the controller 100 starts the supplying mode operation (S6) to rotate the supplying motor 73 by 10 full-rotations and rotate the development driving motor 27 for 10 sec (S7). The controller 100 detects the toner content TD(Indc) in real time for 9-10 from the start of the rotation of the development driving motor 27 (S8). When (d) is discriminated, the supplying mode operation is stopped, and the resumption of the image forming operation is permitted (S10). In other words, when the following inequality becomes satisfied, the supplying mode operation is stopped.

$$\Delta TD\text{ratio}((\text{New}))=TD(Indc)-TD(\text{target})\geq -0.5\% \quad (11)$$

In FIG. 11, the steps S9 et seq., are the same as those in Embodiment 1, and the detailed description thereof are omitted by assigning the same reference numerals as in FIG. 7.

Comparison with Embodiment 1

Figure 12:
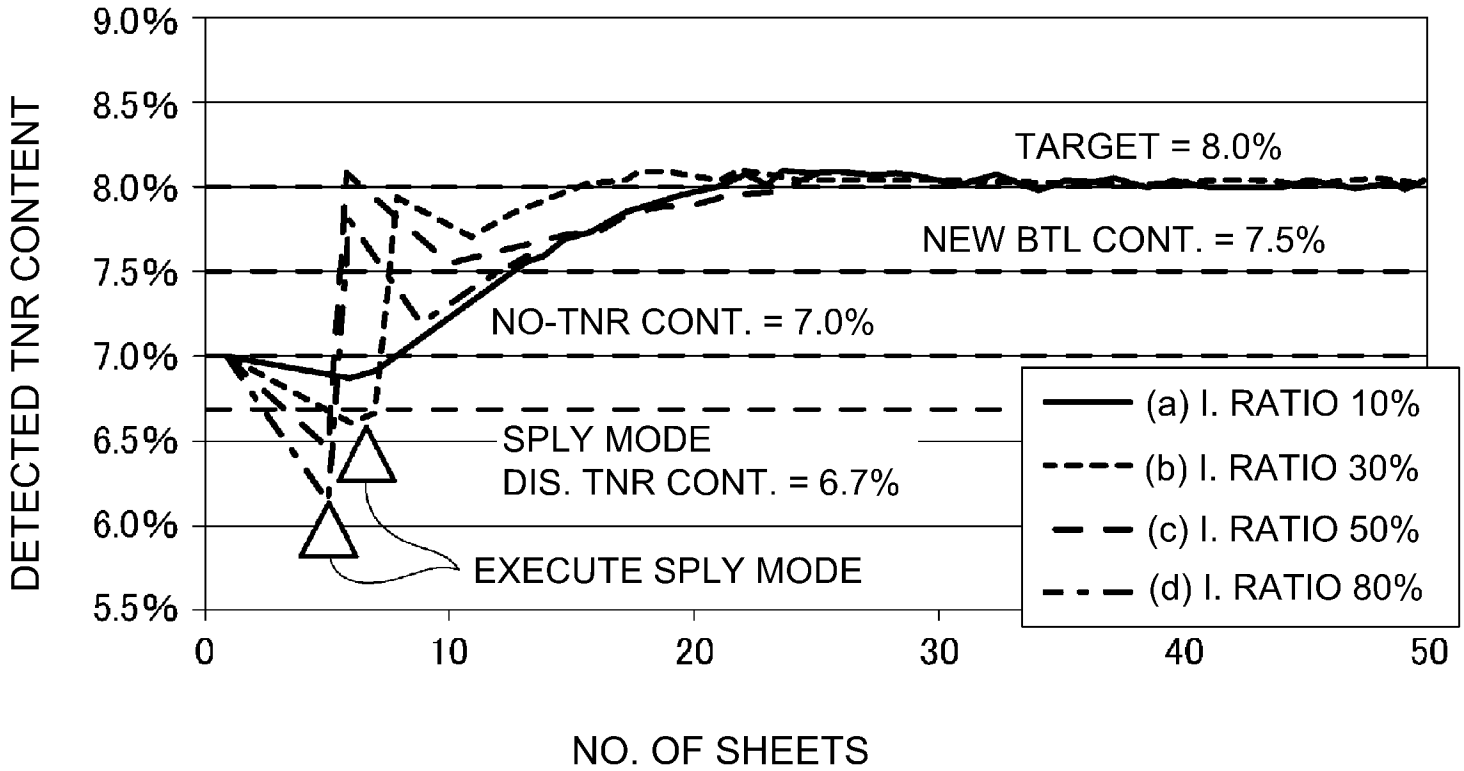
FIG. 12 shows an effect of the control of the reference example 1.

As shown in FIG. 12 and referring to FIG. 2, after the exchange of the toner bottle 70, the image forming operations are carried out with the respective image ratios, and the toner content TD(Indc) actually detected by the inductor sensor 26 changes.

As a result, when the image ratios are 50%, the TD ratio close to the 6.5% which is the NG level continues for a while. When the image ratios are 80%, the toner supply is not quick enough after the detection of the toner content of 6.7%, with the result of decrease of the TD ratio to a level significantly lower than the NG level of 6.5%.

With the image forming apparatus of the present invention, when the developer container is exchanged, the prohibition of the image forming operation is released and permits the image forming operation respective of the detection result of the detecting means until the predetermined condition is reached. Therefore, the down time can be reduced, as compared with the case in which the image forming operation is unconditionally prohibited. On the basis of the detection result of the detecting means at the time when the predetermined condition is reached, the necessity for the prohibition of the image forming operation is determined. Therefore, the decrease of the toner content in the developing device beyond the tolerable range can be easily avoided, as compared with the case in which the image forming operation is unconditionally prohibited.

Therefore, the necessary prohibition of the image forming operation is assuredly executed, whereas unnecessary prohibition of the image forming operation does not occur. The down time of the image forming apparatus can be reduced, while avoiding the decrease of the toner content in the developing device beyond the tolerable range.

INDUSTRIAL APPLICABILITY

According to the present invention, there is provided an image forming apparatus in which unnecessary prevention of the image forming operation is avoided, while assuring necessary prevention of the image forming operation, so that the decrease of the toner content in the developing device beyond the tolerable range is avoided, and the down time of the image forming apparatus is reduced.

The invention claimed is:

1. An image forming apparatus comprising:

an image bearing member capable of carrying an electrostatic image;

a developing device configured to develop an electrostatic image formed on said image bearing member into a toner image, using a developer including toner and carrier;

an exchangeable developer container configured to supply the developer into said developing device;

a content sensor configured to detect information relating to a toner content in said developing device;

an exchange detecting portion configured to detect an exchanging operation of said developer container; and a controller configured to control a supplying operation for supplying developer from said developer container to said developing device on the basis of a detection result of said content sensor and execute a developer supplying mode for supplying developer from said developer container to said developing device while prohibiting an image forming operation, wherein said controller controls the supplying operation so as to permit the image forming operation without executing the developer supplying mode until an amount of formed image data reaches a predetermined level after detection of the exchange of said developer container by said exchange detecting portion.

2. An apparatus according to claim 1, wherein the developer supplying mode is executed when the toner content in said developer container, detected by said content sensor when the predetermined level is reached, is lower than a first threshold.

3. An apparatus according to claim 1, wherein said controller enables the image forming operation when the toner content in said developer container, detected by said content sensor when the predetermined level is reached, is higher than a first threshold.

4. An apparatus according to claim 2, wherein said controller initiates an exchange of said developer container when the toner content in said developer container is less than a second threshold, which is lower than the first threshold.

5. An apparatus according to claim 4, wherein when the toner content in said developer container is lower than the second threshold, said controller prohibits the image forming operation before detection of the exchange of said developer container by said exchange detecting portion.

6. An apparatus according to claim 1, wherein the amount of formed image data is a cumulative video count.

7. An apparatus according to claim 1, wherein when said exchange detecting portion detects the exchange of the developer container, at least one image forming operation is permitted.

8. An apparatus according to claim 6, wherein the cumulative video count is larger than a video count corresponding to one image having 100% print ratio.

9. An apparatus according to claim 1, wherein said controller controls the supplying operation supplying the developer from said developer container to said developing device on the basis of the detection result of said content sensor, from detection of the exchange of said developer container by said the exchange detecting portion at least to reaching a predetermined amount of the formed image data.

10. An apparatus according to claim 1, wherein said content sensor is an inductance sensor configured to detect a magnetic permeability.

11. An apparatus according to claim 1, wherein said controller discriminates whether to execute the developer supplying mode, after an amount of formed image data reaches a predetermined level.

12. An image forming apparatus comprising:

an image bearing member capable of carrying an electrostatic image;

a developing device configured to develop an electrostatic image formed on said image bearing member into a toner image, using a developer including toner and carrier;

an exchangeable developer container configured to supply the developer into said developing device;

a content sensor configured to detect information relating to a toner content in said developing device;

an exchange detecting portion configured to detect of an exchanging operation of said developer container; and a controller configured to control a supplying operation for supplying developer from said developer container to said developing device on the basis of a detection result of said content sensor and execute a developer supplying mode for supplying developer from said developer container to said developing device while prohibiting an image forming operation, wherein said controller controls the supplying operation so as to permit a predetermined number of image forming operations without executing the developer supplying mode after the exchange detecting portion detects a detection of the exchange of said developer container.

13. An apparatus according to claim 12, wherein the developer supplying mode is executed when the toner content in said developer container, detected by said content sensor after the execution of the predetermined number of image forming operations, is lower than a first threshold.

14. An apparatus according to claim 12, wherein said controller enables the image forming operation when the toner content in said developer container, detected by said content sensor after the execution of the predetermined number of image forming operations, is higher than a first threshold.

15. An apparatus according to claim 13, wherein said controller initiates an exchange of said developer container when the toner content in said developer container is less than a second threshold, which is lower than the first threshold.

16. An apparatus according to claim 15, wherein when the toner content in said developer container is lower than the second threshold, said controller prohibits the image forming operation before detection of the exchange of said developer container by said exchange detecting portion.

17. An apparatus according to claim 12, wherein said controller controls the supplying operation supplying the developer from said developer container to said developing device on the basis of the detection result of said content sensor, from detection of the exchange of said developer container by said the exchange detecting portion at least to reaching a predetermined amount of the image forming operations.

18. An apparatus according to claim 12, wherein said content sensor is an inductance sensor configured to detect a magnetic permeability.

19. An apparatus according to claim 12, wherein said controller discriminates whether to execute the developer supplying mode, after the amount of image forming operations data reaches the predetermined number.

20. An image forming apparatus comprising:

an image bearing member capable of carrying an electrostatic image;

a developing device configured to develop an electrostatic image formed on said image bearing member into a toner image, using a developer including toner and carrier;

an exchangeable developer container configured to supply the developer into said developing device;

a content sensor configured to detect information relating to a toner content in said developing device;

an exchange detecting portion configured to detect of an exchanging operation of said developer container; and a controller configured to control a supplying operation for supplying developer from said developer container to said developing device on the basis of a detection result of said content sensor and execute a developer supplying mode for supplying developer from said developer container to said developing device while prohibiting an image forming operation, wherein said controller controls the supplying operation so as to permit the image forming operation without executing the developer supplying mode within a predetermined period after the exchange detecting portion detects a detection of the exchange of said developer container.

21. An apparatus according to claim 20, wherein the developer supplying mode is executed when the toner content in said developer container, detected by said content sensor after elapse of the predetermined period is lower than a first threshold.

22. An apparatus according to claim 20, wherein said controller enables the image forming operation when the toner content in said developer container, detected by said content sensor after elapse of the predetermined period is higher than a first threshold.

23. An apparatus according to claim 21, wherein said controller initiates an exchange of said developer container when the toner content in said developer container is less than a second threshold, which is lower than the first threshold.

24. An apparatus according to claim 23, wherein when the toner content in said developer container is lower than the second threshold, said controller prohibits the image forming operation before detection of the exchange of said developer container by said exchange detecting portion.

25. An apparatus according to claim 20, wherein said controller controls the supplying operation supplying the developer from said developer container to said developing device on the basis of the detection result of said content sensor, from detection of the exchange of said developer container by said the exchange detecting portion at least to reaching a predetermined amount of the formed images.

26. An apparatus according to claim 20, wherein said content sensor is an inductance sensor configured to detect a magnetic permeability.

27. An apparatus according to claim 20, wherein after the elapse of the predetermined period, said controller discriminates whether to execute the developer supplying mode.

28. An image forming apparatus comprising:

an image bearing member capable of carrying an electrostatic image;

a developing device configured to develop an electrostatic image formed on said image bearing member into a toner image, using a developer including toner and carrier;

an exchangeable developer container configured to supply the developer into said developing device;

a content sensor configured to detect information relating to a toner content in said developing device;

an exchange detecting portion configured to detect of an exchanging operation of said developer container; and a controller configured to control a supplying operation for supplying developer from said developer container to said developing device on the basis of a detection result of said content sensor and execute a developer supplying mode for supplying developer from said developer container to said developing device while prohibiting an image forming operation, wherein the image forming operation is permitted without executing the developer supplying mode, after the exchange detecting portion detects the exchange of said developer container.

29. An apparatus according to claim 28, wherein after the image forming operation, said controller discriminates whether to execute the developer supplying mode.

30. An apparatus according to claim 29, wherein the developer supplying mode is executed when the toner content in said developer container, detected by said content sensor, is lower than a first threshold.

31. An apparatus according to claim 29, wherein said controller enables the image forming operation when the toner content in said developer container, detected by said content sensor, is higher than a first threshold.

32. An apparatus according to claim 29, wherein said controller initiates an exchange of said developer container when the toner content in said developer container is less than a second threshold, which is lower than the first threshold.

33. An apparatus according to claim 32, wherein when the toner content in said developer container is lower than the second threshold, said controller prohibits the image forming operation before detection of the exchange of said developer container by said exchange detecting portion.

34. An apparatus according to claim 28, wherein said controller controls the supplying operation supplying the developer from said developer container to said developing device on the basis of the detection result of said content sensor, from detection of the exchange of said developer container by said the exchange detecting portion at least to reaching a predetermined amount of the formed images.

35. An apparatus according to claim 28, wherein said content sensor is an inductance sensor configured to detect a magnetic permeability.

36. An image forming apparatus comprising:

an image bearing member capable of carrying an electrostatic image;

a developing device configured to develop an electrostatic image formed on said image bearing member into a toner image, using a developer including toner and carrier;

an exchangeable developer container configured to supply the developer into said developing device;

a content sensor configured to detect information relating to a toner content in said developing device;

an exchange detecting portion configured to detect of an exchanging operation of said developer container; and a controller configured to control a supplying operation for supplying developer from said developer container to said developing device on the basis of a detection result of said content sensor and execute a developer supplying mode for supplying developer from said developer container to said developing device while prohibiting an image forming operation, wherein at least one image forming operation is permitted without executing the developer supplying mode, after the exchange detecting portion detects the exchange of said developer container and before said controller discriminates whether to execute the developer supplying mode.

37. An apparatus according to claim 36, wherein said controller discriminates whether to execute the developer supply, and the execution of the image forming operation.

38. An apparatus according to claim 37, wherein the developer supplying mode is executed when the toner content in said developer container, detected by said content sensor, is lower than a first threshold.

39. An apparatus according to claim 37, wherein said controller enables the image forming operation when the toner content in said developer container, detected by said content sensor, is higher than a first threshold.

40. An apparatus according to claim 37, wherein said controller initiates an exchange of said developer container when the toner content in said developer container is less than a second threshold, which is lower than the first threshold.

41. An apparatus according to claim 40, wherein when the toner content in said developer container is lower than the second threshold, said controller prohibits the image forming operation before detection of the exchange of said developer container by said exchange detecting portion.

42. An apparatus according to claim 36, wherein said controller controls the supplying operation supplying the developer from said developer container to said developing device on the basis of the detection result of said content sensor, from detection of the exchange of said developer container by said the exchange detecting portion at least to reaching a predetermined amount of the formed images.

43. An apparatus according to claim 36, wherein said content sensor is an inductance sensor configured to detect a magnetic permeability.

44. An apparatus according to claim 1, wherein in a case that a mounted developer container is dismounted and then replaced with a developer container having a smaller amount of developer than that of the dismounted developer container, a signal relating to the amount of developer is produced.

45. An apparatus according to claim 44, wherein in a case when the smaller developer container is exchanged after the signal, the developer supply mode is executed before the image forming operation.

46. An apparatus according to claim 12, wherein in a case that a mounted developer container is dismounted and replaced with a developer container having a smaller amount of developer than that of the dismounted developer container, a signal relating to the amount of developer is produced.

47. An apparatus according to claim 46, wherein in a case when the smaller developer container is exchanged after the signal, the developer supply mode is executed before the image forming operation.

48. An apparatus according to claim 20, wherein in a case that a mounted developer container is dismounted and replaced with a developer container having a smaller amount of developer than that of the dismounted developer container, a signal relating to the amount of developer is produced.

49. An apparatus according to claim 48, wherein in a case when the smaller developer container is exchanged after the signal, the developer supply mode is executed before the image forming operation.

50. An apparatus according to claim 28, wherein in a case that a mounted developer container is dismounted and replaced with a developer container having a smaller amount of developer than that of the dismounted developer container, a signal relating to the amount of developer is produced.

51. An apparatus according to claim 50, wherein in a case when the smaller developer container is exchanged after the warning, the developer supply mode is executed before the image forming operation.

52. An apparatus according to claim 36, wherein in a case that a mounted developer container is dismounted and replaced with a developer container having a smaller amount of developer than that of the dismounted developer container, a signal relating to the amount of developer is produced.

53. An apparatus according to claim 52, wherein in a case when the smaller developer container is exchanged after the signal, the developer supply mode is executed before the image forming operation.

* * * * *